United States Patent [19]

Wilsdorf

[11] 4,358,699

[45] Nov. 9, 1982

[54] VERSATILE ELECTRICAL FIBER BRUSH AND METHOD OF MAKING

[75] Inventor: Doris Wilsdorf, Charlottesville, Va.

[73] Assignee: The University of Virginia Alumni Patents Foundation, Charlottesville, Va.

[21] Appl. No.: 156,630

[22] Filed: Jun. 5, 1980

[51] Int. Cl.[3] ..... H01R 39/24

[52] U.S. Cl. ..... 310/251; 200/164 R; 428/611

[58] Field of Search ..... 310/248, 249, 251, 252, 310/228, 227, 220, 238, 246; 339/48, 49 R; 200/164 R; 428/611

[56] References Cited

U.S. PATENT DOCUMENTS

| | | | |
|---|---|---|---|
| 2,486,042 | 10/1949 | Lesigne | 200/164 R |
| 3,423,715 | 1/1969 | Drescher | 310/248 |
| 4,277,708 | 7/1981 | McNab | 310/228 |

*Primary Examiner*—J. V. Truhe
*Assistant Examiner*—Morris Ginsburg
*Attorney, Agent, or Firm*—Oblon, Fisher, Spivak, McClelland & Maier

[57] ABSTRACT

A versatile electrical fiber brush comprising the following components: Firstly a brush body, which is not necessarily equiaxed, non-porous, rigid or all in one piece, made of a matrix material, not necessarily electrically conductive, embedded in which is at least one set of similarly formed fibers, in which there may be embedded other, thinner fibers, and in these fibers still thinner fibers. Secondly, at least one fibrous part which is formed by removing from a part of the brush body most or all of the matrix material plus, as the conditions may make it advisable, some fibrous material. Third, at least one working surface, this being the macroscopic surface of a brush where it makes contact with the object(s) to which electrical connection shall be made. Fourth at least one set of electrically conductive fiber wires which form at least part of the working surface as well as of the fibrous part. The mechanical resilience and compliance of the fibrous parts is controlled by a system of secondary and tertiary fibers, these being generated from the embedment of fibers in fibers in the body of the brush. The electrical properties of the brush are controlled by the fiber wires. By making extremely large numbers of fiber wires of very small diameters to contact the object at the working surface of a brush, quantum-mechanical tunneling is expected to become the predominant mechanism of current conduction, yielding extremely good brush performance, while at same time brush wear is forecast to be very low.

100 Claims, 28 Drawing Figures

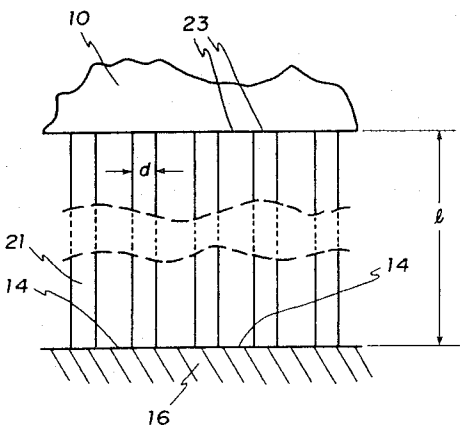
FIG. 4a
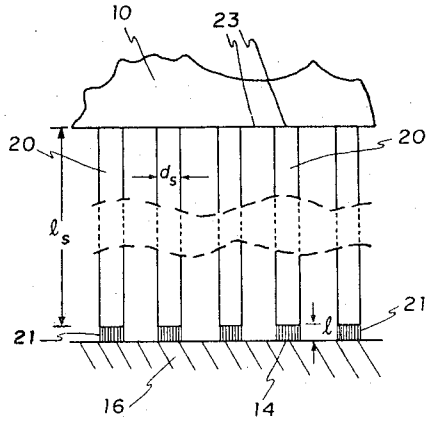
FIG. 4b
FIG. 4c
FIG. 4d

VERSATILE ELECTRICAL FIBER BRUSH AND METHOD OF MAKING

BACKGROUND OF THE INVENTION

1. Field of the Invention

This invention relates to an electrical brush for making electrical connection to one or more objects, often but not necessarily having predetermined shape and predetermined orientation relative to the brush, such as a slip ring in a motor or electrical generator, a brush holding device, and/or a stationary contact in a switch. This invention also relates to methods of making such an electrical brush.

2. Description of the Prior Art

Electrical brushes for utilization in electrical applications have long been known in the prior art. Perhaps the earliest modern electrical brush was disclosed by Edison in U.S. Pat. No. 276,233, which resulted in numerous suggested improvements on electrical brushes, as well as related inventions which have otherwise never found significant application.

Thomson, in U.S. Pat. No. 539,454, recognized various advantages of electrical brushes constructed of plural lightly metalized carbon filaments, and in particular the improved brush conductivity, elasticity and reduced mechanical and electrical resistance thereby provided.

More modern development of electrical brushes is evidenced in U.S. Pat. No. 3,668,451 to McNab and U.S. Pat. No. 3,821,024 to Wilkin et al. In the McNab patent is disclosed an electrical brush formed of refractory non-conducting fibers, each of which has deposited thereon a metal film on the surface thereof to carry current. According to McNab, the fibers can be of very small diameter, less than 10,000ths of an inch, and with a relatively thin metallic coating resulting in a considerably more flexible brush having greater current carrying capacity than the brushes known prior to that time. In the Wilkin et al patent, an electrical brush is constructed using carbon fibers coated with an underlayer of nickel and an outer layer of silver having an average filament diameter of 7.5 μm coated with metal layers estimated as having thicknesses of on the order of 1 μm. According to Wilkin et al, improved electrical performance is thereby attained due to the fact that the nickel underlayer adheres better to the carbon fiber while making excellent connection to the silver outer layer. In addition to nickel, underlayers of chromium, iron and cobalt are identified as being suitable, while overlayers of gold, copper and alloys of silver and copper are also identified as being suitable overlayers.

Insofar as the prior art methods of making fiber brushes are concerned, these methods were rather straightforward as long as metal fibers or wires having diameters of 100 μm or more were used, namely via the mechanical assembling of bundles of fibers like ordinary brushes. In that case one may begin with already assembled wire or fiber materials such as grounding cables, spooled wire or fibers, or woven material out of which the weft, for example, is removed, leaving only the warp. With carbon fibers such methods are feasible down to much smaller diameters since carbon fibers are commercially available in tows and at relatively modest cost, including diameters of the individual filaments on the order of 10 μm. With metals, the cost of wire material rises very steeply with decreasing diameters and becomes prohibitive.

A grave disadvantage of mechanical methods of brush making using fibers of small diameters is the difficulty of reliably adjusting the packing density on a small scale, as well as to shape the brush surface to conform to the surface of an object to which the brush is ultimately required to make electrical contact. Shaping of the brush surface is further complicated where an angle of attack other than 90° is required to make contact with the object, for example, a rotor in an electrical motor or generator. Shaping of the brush is not necessary for brush diameters that are sufficiently small. Also, it does not pose much of a problem if the packing density is high, for example, 25% or higher depending on fiber smoothness, since at such packing density the internal friction among the fibers renders the brush relatively stiff. However, at low packing density serious problems are otherwise encountered.

Various methods, as represented by U.S. Pat. No. 3,394,213 to Roberts et al and U.S. Pat. No. 3,277,564 to Webber et al, are disclosed in the prior art for forming microscopic filaments of long length. As taught by Webber et al, a sheathed wire is firstly drawn down through a suitable die to reduce the diameter of the wire within the sheath, whereupon a plurality of the reduced sheath wires are then disposed within a sheath formed of a suitable matrix material which may but need not necessarily comprise the same material as the sheath wires. The bundle of sheathed wires is then drawn down to define another reduced diameter, which can be successively drawn down to even smaller diameters as may be required for a particular application. Individual filaments of reduced diameter are then obtained from the final bundle by etching away the matrix material. In the Roberts et al disclosure, plural filaments having a diameter of under 15 μm are formed by providing in a housing material a bundle of substantially parallel sheathed elongated drawable elements from which the filaments are to be formed, evacuating the housing, heat forming the evacuated housed bundle, cold drawing the bundle to further reduce the cross-section of the elements therein and then removing the housing and sheathing materials by means of etching.

Another prior art patent of interest is U.S. Pat. No. 3,818,588 to Bates, which discloses an electrical brush constructed by molding an aligned array of metal coated carbon fibers onto a block. According to Bates, the block may be several times the required length and width of a brush, in which case it is then cut into strips corresponding to the desired length of the brush. The coating is then removed for part only of the length of the brush to expose the individual carbon fibers at one end but leaving them consolidated for connection to a conductor at the other end, whereupon the strips are finally cut up to form individual brushes.

Although the concept of fiber electrical brushes is not of itself new, widespread introduction of fiber brushes has been prevented, presumably for several reasons. Firstly, fiber brushes tend to be more expensive than solid, i.e. "monolithic" brushes. Secondly, the monolithic graphite brush was successfully improved to the point that from the technical viewpoint, its losses are easily tolerable for the large majority of common applications, its lifetime is long, and its cost low, albeit the cost of energy lost in the brushes will often exceed their cost. Thirdly, while the broad concept of fiber brushes was known, a theoretical understanding of the interrelationship of brush parameters, such as packing density, fiber diameter, brush pressure and fiber length, as well as experimental testing, was lacking, thereby effectively precluding derivation of optimum brush parameter combinations. Additionally, past failure to achieve superior performance hypothesized for fiber brushes may have further discouraged purposeful research, to the extent that electrical fiber brushes exhibiting the expected performance have not heretofore been available.

During the past several years, a new interest in the development of improved brushes, whether fiber or monolithic, has arisen due to the development of engineering concepts and planned devices which call for very low "noise" of the brushes, or very high current densities, or high relative speeds, often with only small potential differences driving the currents, demanding much lower losses per ampere conducted than was previously permissible, or any combination of the above conditions. As a result, the prior art brushes cannot meet the envisioned considerably more stringent requirements, necessitating the development of the improved electrical fiber brush of the invention.

SUMMARY OF THE INVENTION

Accordingly, one object of this invention is to provide a new and improved electrical fiber brush capable of meeting the stringent requirements of modern applications, i.e. capable of operating at high current densities and high relative speeds with reduced losses per ampere conducted, and low noise.

Another object of this invention is to provide a versatile electrical fiber brush having a very large number of current carrying spots (called a-spots), and good compliance for operation at reduced mechanical loading.

Yet another object of this invention is to provide a versatile electrical fiber brush exhibiting lower electrical and/or mechanical losses, especially at high velocities.

Another object of this invention is to provide a versatile electrical fiber brush capable to be used at very high current densities.

Another object of this invention is to provide a versatile electrical fiber brush exhibiting low contact resistance when making electrical connection to stationary as well as moving or rotating objects.

Another object is to provide a versatile electrical fiber brush which produces considerably lower electrical/radio noise than heretofore possible.

Yet another object is to provide a versatile electrical fiber brush which can be used to make a wide variety of electrical connections, replacing, for example, solder joints, screw connectors and/or other connector devices, including parts or all of those previously needed to supply current to electrical brushes.

Another object of this invention is to provide a versatile electrical fiber brush which exhibits the above-noted improved performance regardless of whether or not the brush is conducting direct or alternating current.

Another object of this invention is to provide a versatile electrical fiber brush which exhibits the above-noted improved performance at reduced ambient pressures such as encountered by high-flying aircraft and in space.

Yet another object of the invention is to provide a versatile electrical fiber brush showing reduced wear and thus capable of long use times.

A further object of this invention is to provide an electrically conductive fibrous material which when pressed lightly against an opposing surface provides many electrical contact spots.

Yet another object of this invention is to provide a fibrous material which when pressed lightly against an opposing surface provides many mechanical contact spots.

Yet another object of this invention is to provide a fibrous material which when pressed lightly against a smooth opposing surface in relative motion to the fibrous material will show very little wear.

Yet another object of the invention is to provide a novel simple method to make electrical connections among two or more objects simultaneously which may be at rest or in various states of relative motion.

A further object of this invention is to provide novel methods for producing the above-noted versatile electrical fiber brush, wherein the composite shape of at least one contacting brush surface is shaped in correspondence to the shape and relative position of at least one object, such as a rotor, slip ring, or stationary contact, to which the electrical brush is intended to make contact.

Another object of the present invention is to provide novel methods, readily adaptable for larger scale technology, for producing the requisite fibrous material.

These and other objects are achieved according to the invention by providing a new and improved electrical brush for making electrical connection to at least one object, and in general $X \geqq 1$ objects, often but not necessarily having predetermined shape and relative position, wherein the brush comprises the following parts: Firstly a solid brush body, not necessarily non-porous, nor necessarily all in one piece, nor necessarily rigid, made of matrix material with at least one set of similarly formed fibers (of arbitrary cross-sectional shape which is not necessarily the same over all of their length and/or everywhere in the brush) embedded therein. The individual fibers in that at least one set may have thinner fibers embedded therein, which thinner fibers, in turn, may have still thinner fibers embedded therein; wherein the word "fiber" designates an object which has one dimension (namely its length) which is much longer than any dimension normal thereto, i.e. in any cross section at right angles to its long direction. Secondly, at least one fibrous part, and in general $M \geqq 1$ fibrous parts, extending from the brush body and consisting of fiber ends or looped sections of fibers extending from the brush body, these being parts of at least some of the fibers embedded in the brush body which meet the surface of the brush body at its interface with the fibrous part. Thirdly, at least one working surface, and in general $Q \geqq 1$ working surfaces, designed to make contact with at least one object, and in general $Z \geqq 1$ objects, these working surfaces being the macroscopic surfaces of the brush where it makes contact with the objects to which electrical connection shall be made, these working surfaces being formed of compositely shaped surfaces of fibers in the respective fibrous parts of the brush. Fourth, at least one set, and in general $Y \geqq 1$ sets, of similar electrically conductive fiber wires of (arbitrary cross-sectional shape, not necessarily the same over all of their length and/or everywhere in the brush), of which at least one set forms at least part of at least one working surface of the brush. These electrically conductive fiber wires make electrical contact spots (the so-called a-spots) with at least one object, through which a-spots electrical current is flowing when the brush makes electrical connection with the at least one object.

Within the brush body, the fiber wires constituting the at least one set of fiber wires may be directly embedded in the matrix, or they may be embedded in other fibers, which are named secondary fibers, and the secondary fibers may be directly embedded in the matrix or they may be embedded in tertiary fibers which are embedded in the matrix. The same principle could also be repeated onto quaternary fibers, and so on, if this should be deemed to be desireable or needed.

In the subsequent description it is helpful to introduce the following definitions: $A_B$ is the cross-sectional area of the at least one working surface; $d=\sqrt{4A/\pi}$ is the (average) diameter of the fiber wires of the at least one set of electrically conductive fiber wires, wherein A is the average cross-sectional area of the fiber wires measured at right angles to their long axis; f, called the packing density or packing fraction, is the fraction which the total cross-sectional area of the metal fiber wires, at the interface between the solid brush body and the fibrous brush part, constitutes of the cross-sectional area of the interface; $d_s$ and $d_t$ are the average diameters of the secondary and tertiary fibers, respectively; l is the average exposed length of the fiber wires.

Within the at least one fibrous part, the fiber wires of diameter d extend from the secondary fibers of diameter $d_s$ in groups of $N_s \geqq 1$ fiber wires per secondary fiber, and the secondary fibers of diameter $d_s$ extend from the tertiary fibers of diameter $d_t$ in groups of $N_t \geqq 1$ secondary fibers per tertiary fiber. Formally, if $N_s=N_t=d/d_s=d_s/d_t=1$ and if the material is the same over the length of the fiber, there are no secondary or tertiary fibers present in the fibrous part concerned and the fiber wires extend directly from the solid part of the brush, generally to end on the working surface. However, it is also possible that many, and perhaps the majority, of the fiber wires form loops projecting out of the solid part of the brush with both of their ends embedded in the matrix.

In preferred embodiments, but not necessarily, the working surface is characterized by the relationship $d/f^{\frac{2}{3}}<56\ \mu m$. This relationship implies very thin fiber wires with the corresponding very low capacity to withstand forces acting on the brush unless the fiber wires are very short. The described construction, including tertiary fibers and/or secondary fibers, if any, has the object to match, by appropriate choices of the different fiber diameters, lengths, numbers and/or shapes, the mechanical compliance of the fibrous part of the brush to the intended working conditions, including the size and shape of the contacted object, the relative speed, and the intended brush pressure $p_B=P/A_B$ where P is the load with which the brush is pressed against said object.

Advantageously, the fibrous part of the brush may contain at least one set of fibers (named support fibers), whose cross-section exceeds that of the fiber wires, and secondary and/or tertiary fibers, if any, whose length is adjusted in relation to the local distances between the solid part of the brush and the intended position of the surface of the contacted object when the brush is in operation, such that all or part of the fiber wires are bent to a desired shape and/or degree of curvature when the support fibers contact the object to be contacted. The function of the support fibers is to serve as spacers which assure appropriate bending of, and thus the exertion of appropriate forces on, the fiber wires when the brush is in operation, and/or to provide protection for the fiber wires (as well as the secondary and/or tertiary fibers, if any) against accidental mechanical damage during handling, installation and/or mechanical brush overload. The support fibers may optionally be replaced by at least one roller and/or rigid non-rotatable object, fixed by conventional means either to the brush body or to the brush holder, or to a part rigidly fixed to either of these two or fixed to the object to be contacted, or to a part rigidly fixed thereto by conventional means, such that when the at least one rigid object and/or roller touches the opposite object (i.e. the contacted object or a part rigidly fixed thereto when the rollers are fixed relative to the brush body or brush holder, and vice versa) the fiber wires are bent to a desired shape and/or degree of curvature. Advantageously, finer wire fibers may project from the support fibers and/or the at least one rigid object and/or roller, either of a length to make electrical contact with the brush body, brush holder and/or object to the contacted when the brush is operating normally, or to make such contact only when the brush is mechanically overloaded.

Further, in preferred embodiments of the invention $p_B/E \leqq 1.8\times10^{-5}f$, where E is Young's modulus of the fibers of diameter d, packing fraction f, and exposed length, l, which are contacting the object to which electrical contact is to be made. Further, also, in preferred embodiments of the invention the material of the fiber wires of diameter d at the working surface of the brush (which when contacting the object to which electrical contact is to be made each form one to three a-spots on the average) is chosen to render a film resistivity $\sigma_F \leqq 3\times10^{-11}\ \tau m^2$ when tested against a polished coper rotor in a pure argon atmosphere under the action of the brush pressure $p_B \leqq 1.8\times10^{-5}fE$, and under the intended working conditions of the brush including the intended ambient temperature and peak current density.

The import of the invention may be briefly summarized as follows: In the known art, fiber brushes are conceived of as making non-permanent electrical contact with one object, and as consisting of one rigid, non-porous, typically roughly equiaxed brush body, made of an electrically conductive matrix material from which projects one fibrous part which is composed of one set of similar fibers of uniform thickness, ending in one working surface, and making contact with one object, wherein the current is led to the brush body via an electrically conductive brush holder constructed to constrain the movement of the brush, or the brush holder may support the fibers directly to assume the role the body of the brush, or the body of the brush may have the degenerate form of solder among metal fibers.

Compared to this state of the known art, the invention consists of two major interrelated parts:

Firstly, the recognition that very different and very superior electrical behavior of the brush is theoretically expected if the preponderant part of the current across the working surface of the brush is conducted via quantum-mechanical tunneling as compared to normal conduction of electricity, and that such preponderance of tunneling to effect the superior brush behavior is expected to occur for $d/f^{\frac{2}{3}} \lesssim 56\ \mu m$.

Secondly, the recognition that the previous concept of electrical fiber brushes is extremely restrictive in a very undesirable and at the same time unnecessary manner, in considering only rigid, non-porous, roughly equiaxed brush bodies, in considering only electrically conductive matrix materials, and in considering only the case of $M=Q=X=Y=Z=N_s=N_t=d/d_s=d/d_t=1$.

Cumulatively, the said restrictions implied (even though apparently not recognized as such) in the prior art are of a nature to make it difficult if not impossible to reduce to practice the concept of quantum-mechanical fiber brushes with their anticipated very great advantages. By removing said restrictions, singly or in various combinations, it becomes possible to penetrate into the regime of quantum-mechanical brush behavior characterized by $d/f^{\frac{2}{3}} \lesssim 56$ μm. Namely, three major obstacles must be overcome in the quest for quantum-mechanical brushes. Firstly, one must achieve adequate compliance, in depth, of said fibrous part of the brush, meaning that the fibrous part must support brush pressures sufficiently large to keep at least a large fraction of the fibers in continuous contact with the object to be contacted while the brush may be in relative motion and to achieve said continuous contact in the presence of unavoidable surface roughnesses and mechanical vibrations that are characteristically very much larger than the metal fiber wire diameters when $d/f^{\frac{2}{3}} < 56$ μm. Another great hurdle is to devise means by which the requisite very fine fibers and fibrous parts thereof can be made. The third great obstacle is to mechanically hold the brushes and to apply to them a steady pressure sufficient to establish and maintain electrical connection but not so large as to cause undue brush wear or mechanical damage to the fibers.

Various aspects of the present invention are designed to overcome these three obstacles and in so doing outline methods to make and effectively use fiber brushes that are capable of operating in the range $d/f^{\frac{2}{3}} < 56$ μm. However, many facets of the described invention are similarly applicable to fiber brushes at any value of $d/f^{\frac{2}{3}}$, and are considered to be valuable contributions to the art of making and using fiber brushes as well as fiber contact materials for stationary applications independent of fiber diameter.

As to quantum-mechanical tunneling, it is current conduction through a very narrow gap between two objects, or parts of objects, which do not actually touch mechanically. Tunneling depends on the wave nature of atomistic charged particles, especially electrons. Considerable detail regarding tunneling in connection with electrical contacts has been given by R. Holm in his book "Electric Contacts" (Springer, New York) 1963 who concludes, however, that tunneling plays no practical role in this connection.

In removing the implied restriction in the known art to shapes of the brush body that are roughly equiaxed, two general cases are considered: Firstly objects having one dimension very much longer than any direction at right angles thereto. This is the case of fibers, already discussed. Wires, threads of yarn, fishing line, and ropes are examples of this case. Secondly, objects having one dimension which is very much shorter than any dimension normal thereto. Examples of this case are sheets of paper, typewriter ribbons, membranes, and discs or chips such as coins. Shapes in which mutually perpendicular directions are of the same order of magnitude are referred to as "equiaxed" in conformity with general scientific usage. More complicated shapes can usually be described as made up of components which are equiaxed and/or having one short dimension and/or having one long dimension. Three specific cases of the combination of objects with one long dimension which have been known for millenia are felting, weaving and knitting, in which objects of one long dimension (i.e. the fibers of animal furs or plants) are bonded together more or less randomly, yielding a felt or paper, or are put together in a regular fashion, yielding a woven or a knitted fabric. In weaving one begins with at least two sets of similar fibers (e.g. the warp and weft of weaving) which are intertwined in a regular manner yielding a woven material. A particular case in this connection is basket weaving or the caning of chairs in which the individual elements are large enough to be handled individually. In the overwhelming number of weaving operations fibers too small to be handled individually are used, necessitating the assembling of the fibers first into tows of loosely assembled parallel fibers which then are transformed into yarns, threads or ropes by a process of systematic twisting operations, sometimes repeated with already twisted material such as in rope making or steel cable making. In the making of carpets and velvet the actual weaving operation may be followed by shearing which consists of mechanically removing fibers beyond some predetermined level above the body of the fabric made up of the woven yarns. The parallel operation in the case of making fiber brushes is forming a working surface by shearing after a brush body has been made by a weaving operation.

Knitting (and crocheting and net making and similar methods) are distinct from weaving in that only one single thread or rope may be (and commonly is) used. It is thus recognized that, in view of the fact that the intended fiber wires in electrical fiber brushes according to the invention can be extremely thin, methods of the textile industry, including spinning, knitting and weaving, as also rope-making may be applied. This aspect has escaped previous attention because of the apparently never recognized restriction to equiaxed brush bodies. Similarly applicable are the methods dealing with membranes, ribbons, chips and foils, as objects having one short dimension as defined above.

Seven distinctly different methods of making fibrous parts on brush bodies, i.e. methods by which at least the fiber wires may be made to protrude from the brush body, are recognized which may be used singly or in combination in the making and/or use of electrical fiber brushes according to the invention:

1. Superficial removal (meaning successive removal of surface layers) of matrix material by etching, dissolution, electrochemical action, oxidation, ion milling, spark erosion, selective evaporation or any other means characterized by detaching atoms or molecules from the matrix material surface singly or in small groups.
2. Superficial removal of matrix material from among the fibers, at a rate faster than the removal of at least some of the fiber wires, by the action of differential wear during brush manufacture and/or use.
3. Differential melting of matrix material from among the fibers, achieved by choosing a matrix material with a lower melting point than the melting point of the fiber wires and/or the secondary fibers and/or tertiary fibers, if any, such differential melting performed as part of the brush manufacture process and/or during brush use, wherein the requisite heat is supplied by conduction from a hot object placed in contact with the brush or the brush stock (meaning the material, including matrix material and embedded fibers, from which the brush is formed) at that area where the fibrous part shall be formed; or by radiative heat directed to said area of the brush stock; or by at least one laser beam directed at said area; or by electrical heat generated by a current flowing through said area; or a combination thereof.

4. Differential deformation, plastic and/or elastic, of the brush and/or the brush stock, wherein the matrix material is chosen to have lesser stiffness (in the elastic and/or plastic range) than the melt fiber wires and/or the secondary and/or tertiary fibers, if any, such that due to lateral extension of the matrix material said fibers protrude beyond the matrix material, and/or such that due to pressure exerted by the body of the brush or the brush stock against a softer object said fibers protrude more deeply into the softer object than the matrix material, said differential deformation applied during brush manufacture and/or during brush use.
5. Application of an electrical field at an angle to the local surface of the brush or brush stock at the area where the fibrous part shall be formed, while the temperature of the matrix material is at or above a level to soften said matrix material sufficiently much to permit motion of fibers relative to the matrix material, to the effect that the forces with which the electrical field acts on the induced electric charges on the fibers cause fiber ends and parts of fibers located in the matrix material near said surface area to be drawn out of the matrix material.
6. Application of a magnetic field in the same manner as envisaged for the case of an electric field in point 5 above, wherein at least the metal fiber wires, or the secondary fibers and/or the tertiary fibers, if any, have ferromagnetic properties. Said ferromagnetic properties may be imparted to said fibers, by making them of a ferromagnetic material such as iron, nickel or cobalt, or by the incorporation of cores, and/or surface coatings of such ferromagnetic material.
7. Choosing a volume fraction of fiber volume to volume of matrix material so high, and/or a binding strength between fibers and matrix material so low, that during brush stock and/or brush manufacture fibers spontaneously protrude out of the matrix material, wherein said low binding strength between matrix material and fibers may optionally be induced only temporarily and/or locally such as via the raising of temperature or the application of a chemical causing the matrix material to soften, said temporary and/or local lowering of said binding strength being effected during brush manufacture and/or during brush use.

The length of support fibers in the fibrous part of the brush may be reduced by selecting an etchant or solvent corrosive to the support fibers but non-corrosive to the metal fiber wires and either dipping the fibrous part into the etchant or solvent to the desired depth, and/or by exposing said fibrous part to the etchant or solvent for a predetermined period of time to effect the partial, but not complete, removal of the support fibers. Similarly, all or part of secondary, tertiary and/or any other unwanted fibers in the fibrous part of a brush may be removed by differential dissolution or etching after forming the fibrous part; in case a roughly planar working surface is desired, the removal by dissolution or etching may advantageously be performed by use of a centrifuge as explained in the patent application by D. Wilsdorf et al., U.S. Patent Application Ser. No. 138,716, filed on Apr. 9, 1980 and entitled "An Electric Brush and Method of Making."

Four distinctly different methods of creating working surfaces on fiber brushes are recognized:

1. Shaping one end of the brush stock in conformity with the predetermined shape and relative position of the object to which electrical contact shall be made, and then etching or in any other manner dissolving away the surrounding matrix material. Protection under U.S. patent law has been sought for this method by D. Wilsdorf et al. U.S. Patent Application Ser. No. 138,716, filed on Apr. 9, 1980 and entitled "An Electric Brush and Method of Making." It is recognized that this same method applies also if the matrix material is not electrically conductive, if secondary and/or tertiary fibers are employed, and if more than one working surface is desired on the same fibrous part of the brush.
2. By means of casting, extrusion, drawing, rolling, milling, turning on a lathe, or other similar methods, shaping out of brush stock a rigid brush body reciprocally to the predetermined shape and relative position of one or more objects to which electrical contact shall be made, and generating the desired fibrous parts by any of, or a combination of, the seven methods enumerated above including the further complete or partial removal of unwanted fibrous material, if any.
3. Firstly, procuring a piece of brush stock of suitable shape whose plastic deformability is sufficient to impart to it a predetermined shape designed to let the completed brush make electrical connection to at least one object. Secondly, generating at least one fibrous part on said piece of brush stock, in predetermined position, using any of, or a combination of, the seven methods enumerated above, including the subsequent complete or partial removal of unwanted fibrous material, if any. Thirdly, plastically deforming the piece of brush stock to generate the predetermined shape. Optionally, steps two or three may be performed in reverse order.
4. Firstly procuring a piece of brush stock of suitable shape whose elastic deformability is sufficient to let the completed brush make electrical connection to at least one object when held in a device to impart to it a suitable elastic deformation when situated in a suitable position and orientation. Secondly, generating at least one fibrous part on the piece of brush stock, in predetermined position, using any of, or a combination of, the seven methods enumerated above, including the complete or partial removal of unwanted fibrous material, if any. Thirdly, placing the so-formed brush into a suitably shaped brush holder, and placing the brush into a predetermined position and orientation, and also imparting to the brush the predetermined elastic deformation.

A specific example of method 2 may be making a brush in the shape of a hollow cylinder with fibrous parts all over the inside and outside cylindrical surfaces. An example of method 3 may be making brush stock in the shape of a thin sheet which is plastically bent to the shape of a specific object to be contacted, such as a rectangular rod, for example. An example to method 4 may be a brush in the shape of a woven material with fibers extending from the threads which constitute the brush body, which brush is glued into a suitably shaped electrically conductive brush holder.

Different methods of leading the current to the brush and/or applying a suitable force to the brush are recognized, besides the standard method of fixing the brush into a brush holder (by means of mechanical friction, or screws, or solder) to which the brush holder the current is led by a cable or other electrical conductor, and applying a force to the brush or the brush holder by means of a mechanical spring, which said spring may have the shape of a helical spring, a leaf spring or a spiral spring, to name the most common examples of springs used for said purposes. Namely, the solder or screws may be replaced, at least partially, by establishing electrical contact between the brush and the brush holder, cable, or other electrical conductor by means of a suitably placed working surface of the brush making electrical contact between the brush and the brush holder, or cable, or other electrical conductor. Further, the mechanical springs may be replaced, at least partly, by making at least part of the brush body in the shape of a spring, such as a helical spring, a spiral spring, or a leaf spring, for example, thereby simplifying the application of a predetermined force on the brush and/or making said application of the brush force more uniform and/or reliable.

For the case that the fiber wires of diameter d are directly projecting from the solid part of the brush many considerations on the use of surface coatings on the fibers (called barrier materials), choice of fiber material and matrix material, making the brush stock, shaping the working surface of the brush, and forming the fibrous part of the brush by etching, apply as set forth in U.S. Patent Application Ser. No. 138,716 by D. Wilsdorf et al. filed on Apr. 9, 1980 and entitled "An Electrical Brush and Method of Making", plus additional ones set out later on.

Similarly, many but not all methods for making brush stock in case tertiary and/or secondary wire fibers are used, are combinations of those proposed in the quoted U.S. Patent Application Ser. No. 138,716, by D. Wilsdorf et al. One important addition to said methods is that it will often be advantageous or necessary to form the fiber wires "in-situ", which "in-situ" formation of fiber wires consists of strongly elongating, by mechanical means, directionally solidified two-phase metals or mixtures of powders, wherein the intended material of the fiber wires is present in the form of separate particles such as particles of a powder, or of a eutectic, or of a eutectoid, or of a precipitate, or of metal in glass tubing or of a segregated phase. The methods of forming fibers "in-situ" were pioneered by G. Wassermann and have since been widely used in other laboratories (compare for example P. Haasen and L. Schultz, in "New Developments and Applications in Composites," Eds. Doris Kuhlmann-Wilsdorf and W. C. Harrigan, Jr., The Metallurgical Society of AIME, Warrendale, PA, 1979, p. 61). The "in-situ" fiber formation which begins with powders as starting material consists in compacting, and/or sintering and then extruding mixtures of powders with spheroidal particle shapes, one component of the mixture being the intended material of the fiber wires, and forming this mixture of powders into wires in a manner such that the initially roughly equiaxed powder particles are drawn out into thin filaments. Alternatively one may begin with a directionally-cooled alloy containing second-phase particles such as of a eutectic, eutectoid, precipitate or segregated phase, which consists of the intended fiber wire material, embedded in the matrix material, and forming said alloy into a wire, rod, strip, or other elongated shape, thereby transforming the second-phase particles into thin long filaments, not necessarily of simple cross-sectional shape (compare Haasen and Schultz, op. cit., and Bevk and Karasek, in "New Developments and Applications in Composites", Eds., Doris Kuhlmann-Wilsdorf and W. C. Harrigan, Jr., *The Metallurgical Society of AIME,* Warrendale, Pa., 1979, p. 101). By either of these two closely related methods, fiber diameters as small as 100 Å can be achieved, and filament densities in excess of $10^{14}$ $m^{-2}$, meaning packing fractions of at least several percent with fairly well separated fibers (compare Haasen and Schultz, op. cit.). Extrusion is the preferred method of deformation in both cases, but rolling, wire drawing and/or swaging may also be used. Rebundling may be used after the material has reached a size to make further drawing inconvenient or too expensive. In regard to such rebundling much the same considerations apply as to rebundling discussed in the patent application of Apr. 9, 1980 by D. Wilsdorf et. al., regardless whether the fiber wires are of a one-phase, two-phase, or multiphase metal, including the use of coatings with a barrier material and/or a layer of matrix material.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein:

FIGS. 4*a* to 4*g* are schematic representations of various possible fiber arrangements in the fibrous part of the electrical fiber brush according to the invention, including the fiber wires which make the actual contact (21), secondary fibers (20), tertiary fibers (18), and support fibers (24);

DESCRIPTION OF PREFERRED EMBODIMENTS

Figure 1B:
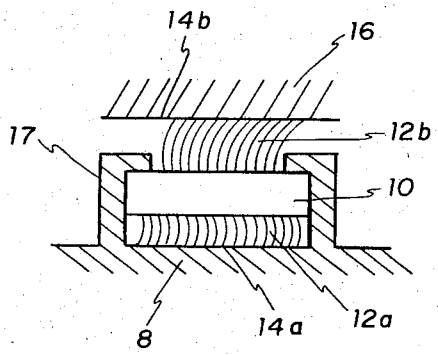
FIGS. 1*a* to 1*k* are schematic representations of different geometries of the versatile electrical fiber brush according to the invention.

Referring now to the drawings, wherein like reference numerals designate identical or corresponding parts throughout the several views, it is firstly noted that the reference numeral designations have the following meaning:

8: Electrically conductive object to which brush is permanently attached and where current is supplied.

10: Solid part of brush composed of matrix material having embedded fiber wires.

**12,12*a*,12*b*,12*c*:** Fibrous parts of brush.

**14,14*a*,14*b*,14*c*:** Working surfaces, being the interfaces between the brush and the objects to which contact is made by the brush and which are the locations of the a-spots.

**16,16*a*,16*b*:** Objects to which contact is made.

17: Mechanical or magnetic holding device typically, but not necessarily, electrically conductive.

18: Tertiary fibers.

20: Secondary fibers.

21: Electrically conductive fiber wires, which when making mechanical contact with objects 16 typically provide one to three a-spots each.

**21*a*: Electrically conductive fibers extending from support fibers 24**.

22: Axis of rotation.

23: Interface between brush body and fibrous part of the brush.

24: Support fibers.

26: Solder joint.

27: Glue joint, preferably made with electrically conductive glue.

28: Plating on object to which contact is made.

30: Rollers whose axis position is fixed in relation to the solid part of the brush, such that when the brush is in operation the fiber wires 21 are bent to a predetermined shape or degree.

32: Spring to apply tension or compression.

Figure 1D:
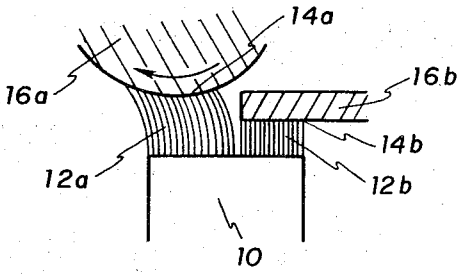
Figure 1A:
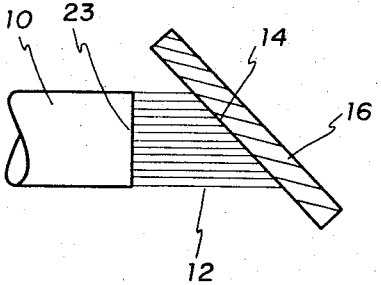
Figure 2A:
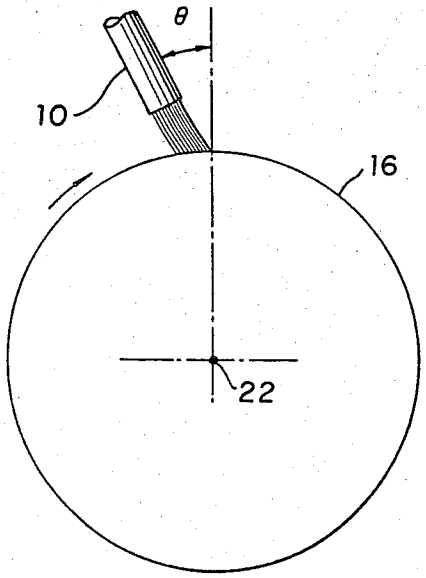
FIGS. 2*a* and 2*b* are schematic front and side views, respectively, of multifiber electrical brushes according to FIG. 1*a* when run on a cylindrical rotor or slip ring in a tangential inclination (FIG. 2*a*) and an axial inclination (FIG. 2*b*)
Figure 2B:
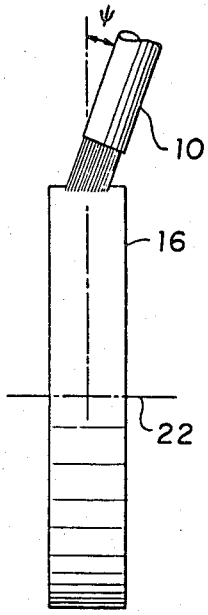

Referring now specifically to FIG. 1*a*, there is shown a brush 10 having plural fibers extending from the brush beyond the interface 23 together forming the fibrous part 12 of the brush, in which the interstices between the fibers are substantially free of matrix material, which fibers by their compositely shaped surfaces, where they contact the object 16 to which electrical connection is made, form the working surface 14 of the brush. This configuration was disclosed in U.S. Patent Application Ser. No. 138,716 by D. Wilsdorf et. al. filed on Apr. 9, 1980 and entitled "An Electric Brush and Method of Making." The typical application of this fiber brush is as shown in FIGS. 2*a* and 2*b*, wherein the brush body 10 is held at right angles, or at an angular inclination, to an object 16 of rotational symmetry, with rotational axis 22, wherein the brush inclination may be tangential to the circumference of the object 16, as in FIG. 2*a*, or axial, i.e. making an angle with the direction of the rotation axis, as in FIG. 2*b*.

According to the invention, many further, new possibilities exist for the shaping and application of fiber brushes, not known in the prior art and not comtemplated in the above-noted patent application by D. Wilsdorf et. al. A number of these are indicated in FIGS. 1*b* to 1*k*, showing the most important new features, as follows: FIG. 1*b* depicts an electrical fiber brush whose brush body 10 has the form of a chip with fibrous parts **12*a* and 12*b***, not necessarily composed of the same kind of fibers, extending from its two larger surfaces, which in the view of FIG. 1*b* are facing upward and downward. The brush is supplied with current from the electrically conductive object 8 to which it is mechanically fastened via the holding device 17 fixed to the object 8 by any convenient conventional means, but such as to insure good electrical contact between the brush and the object 8 through the working surface **14*a* which is at the interface between the fibrous part 12*a* and the object 8**. The anticipated advantage of the arrangement shown in FIG. 1*b* is simplicity of design and potential cost savings, in that the brush may be simply exchanged by slipping it out of an appropriately designed holding device 17 and replacing it with another brush. The contacted object 16 in FIG. 1*b* is drawn with a planar surface such as for a switch. However, the same design may be used if the contacted object is of rotational symmetry and/or is in relative motion with respect to the brush. The distance between the brush holder 17 and the surface of the object 16 in FIG. 1*b* may be fixed so as to bend the fibers in the fibrous part **12*b* to a predetermined degree to insure adequate and not too large brush pressure, or else by means of spring pressure or any other device, not shown, a predetermined force may be applied between the objects 16 and the brush in its holder fastened to the object 8. The stated basic features regarding the application of a predetermined brush pressure through either adjusting the gap between the brush body 10 and the contacted object 16** appropriately, or else through applying a predetermined force by other means, or combining both of these options, which basic features have here been specifically explained in conjunction with FIG. 1*b*, are essentially applicable also to all of the other parts of FIG. 1 unless specifically stated otherwise, and therefore these basic features will not be discussed further.

Figure 1C:
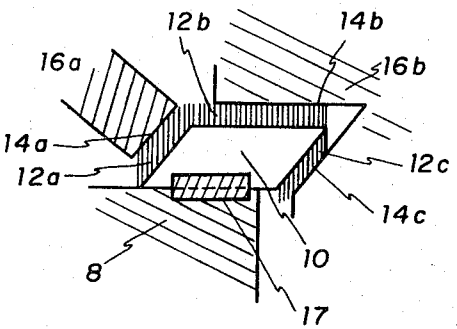

Beyond several basic features of brush design and loading, which have already been explained, FIG. 1*c* illustrates the possibility of arranging the fiber direction in the fibrous parts of the brush at arbitrary angles, as shown in the fibrous parts **12*a* and 12*c* as compared to 12*b*. The figure further illustrates the possibility of providing more than two, i.e. in this case three, fibrous parts (namely 12*a*, 12*b* and 12*c*) on the same brush, and utilizing some of the same fibers in two differently inclined fibrous parts (as in parts 12*b* and 12*c* near the top right corner of the brush body 10**). FIG. 1*c* further illustrates the possibility of contacting more than one object simultaneously (namely objects **16*a* and 16*b*), as well as the possibility of contacting the same object by means of more than one fibrous part (namely contacting object 16*b* via fibrous parts 12*b* and 12*c* at the working surfaces 14*b* and 14*c*). The brush is drawn as fixed to the object 8, by which the brush is supplied with current, by means of the holding device 17**, wherein the mechanical attachment may be done by any conventional means, such as soldering or glueing, or screwing, or riveting, or by mechanical friction, or any other, including also, for example, magnetic action as in a magnetic door catch if the brush body should be ferromagnetic.

FIG. 1*d* illustrates the possibility of providing the same fibrous part with two different working surfaces, namely the left part of the fibrous part with the working surface 14*a*, contacting the moving object 16*a*, while the right part contacts the stationary object 16*b* via the working surface 14*b*. In numbering the two sides of the fibrous part with different numerals, namely 12*a* and 12*b*, the further possibility is indicated that the fibers in these two parts may not only be of different length, but also consist of different materials and thus comprise at least two different sets of fibers, perhaps including two different sets of fiber wires making electrical contact to objects 16*a* and 16*b*, respectively. Regardless of specific shapes, the arrangement depicted in FIG. 1*d* could be advantageous in conducting current from object 16*b* to 16*a*, and vice versa, as distinct from the more readily apparent possibility that current flowing through the brush body is supplied, in parallel, to bodies 16*a* and 16*b*. In the alternative use as indicated, namely conducting current from 16*a* to 16*b*, or vice versa, the brush would serve the same function as the brushes in FIGS. 2*a* and 2*b* with respect to the current supply permanently fixed to the brush body 10, albeit in a novel fashion and involving a minimal amount of fittings, etc.

Figure 1F:
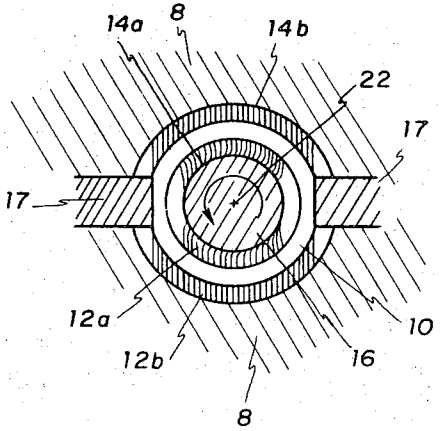
Figure 1H:
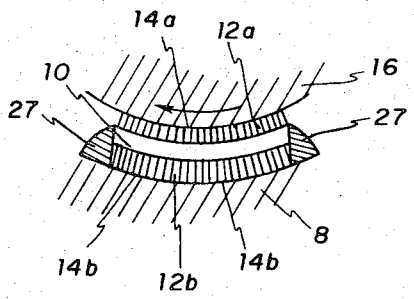
Figure 1E:
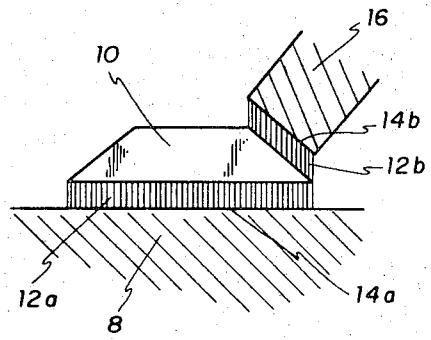

FIG. 1*e* is a variant to FIG. 1*c* in regard to the arbitrary inclination of the fibers and use of the same fibers in two different fibrous parts, namely fibrous parts 12*a* and 12*b*, ending in the working surfaces 14*a* and 14*b*. This figure also indicates the possibility that the brush may not be fixed rigidly to the object 8 from which the current is supplied but may rest on it held by gravity, by the force exerted on it by the object to be contacted, or held by magnetic force if the brush body 10 is ferromagnetic. The figure also is meant to suggest the possibility that the brush may slide on the object 8 and in this manner of use may serve as a switch to make contact with various objects 16 distributed at a suitable distance above the object 8. In this form of use, if the brush body 10 is made of a ferromagnetic material and the current is supplied through an object 8 in the form of a plate, the brush may be moved by means of a magnet making the corresponding motions underneath the plate 8 without making mechanical contact with that object 8, or by means of a magnetic field made to move by electronic means. In this manner a switching system of great versatility and activated by slight forces can be constructed.

In FIG. 1*f* there is shown a brush body 10 in the shape of a hollow cylinder with fibrous parts both on the inside (numeral 12*a*) and outside (numeral 12*b*) surfaces, respectively ending in the working surfaces 14*a* and 14*b*, whereby the working surface 14*a* is making electrical contact with the object 16 having rotation axis 22. Current is supplied through object 8 via the working surface 14*b* and the fibrous part 12*b*; to the brush body and thence to fibrous part 12*a* and object 16. The holding device 17 is connected to object 8 by any desirable conventional means, and it is not necessarily in a fixed position with respect to object 8. Thus, for example, it could rotate about the rotational axis 22, optionally with variable velocity and direction. Similarly, neither the direction nor the speed of motion of object 16 needs to be constant, nor indeed finite. Further, the object 16 as well as the object 8 and brush body 10 could be segmented in planes parallel to the plane of the drawing, these segments being of equal thickness and separated by insulating layers, for example. In this manner, the arrangement of FIG. 1*f* would represent a switch making contact between several or many different object, or, similarly, could be a brush arrangement supplying several or many circuits. These examples are not meant to be exclusive but are meant only to indicate some of a number of different possible uses of arrangements that have a cross section as indicated in FIG. 1*f*. One may add, finally, that the object 16 could also be replaced by a sphere that may be shifted along the direction normal to the plane of the drawing. Finally, either the inner or the outer fibrous parts and their working surfaces could be omitted, and the brush could be formed in the shape of a circular rod with one or more fibrous parts on the outer surface, or the brush could have the shape of a rod with arbitrary cross-sectional shape, with or without any hole in axial direction.

Figure 1G:
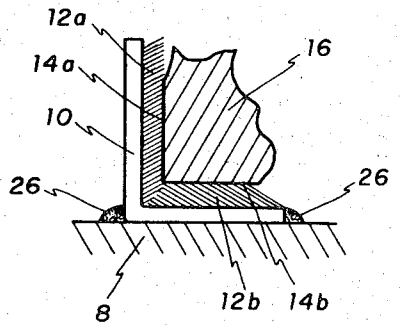
Figure 1I:
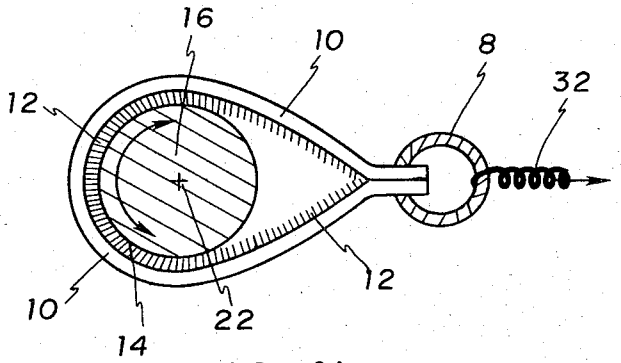

FIGS. 1*g*, 1*h* and 1*i* indicate various possibilities of shaping working surfaces of brushes made from brush stock supplied in very simple initial forms, such as sheet, or strip, or membranes, from which appropriate pieces may be cut off, say, thereby providing the possibility of inexpensive mass production. In FIG. 1*g*, the working surfaces 14*a* and 14*b* at which the fibrous parts 12*a* and 12*b* terminate and make contact with the object 16, are conceived of as having been originally one, namely as the continuous fibrous layer on a piece of brush body in the form of a uniform sheet or strip, and having been transformed into the shape shown in FIG. 1*g* through plastically bending that sheet or strip through a right angle. The means of attachment of the so-formed brush to the body 8 from which current is supplied is visualized in that case by soldering. However, any other suitable means of attachment would similarly be acceptable, such as through glueing, especially with an electrically conductive glue, or such as by means of simple clips, or other.

While FIG. 1*g* illustrates the shaping of a brush body, and thus the shaping of the working surface(s) by plastic deformation, FIG. 1*h* gives an example of effecting that shaping through elastic deformation. In this case the brush body 10 is visualized as having been a piece of flat strip or a flat chip with fibers emerging from both surfaces which has been forced into an elastically bent shape through glueing it to the curved surface of object 8, through which the current is supplied and thence flows through the brush via working surface 14*b*, thence fibrous part 12*b*, thence through the body 10 of the brush, into fibrous part 12*a* and through the working surface 14*a* into the object 16. It should be noted that it is not necessary that the matrix material in this case be electrically conductive as long as adequate electrical conductivity is present along the direction of the fibers. This will generally be the case given any packing density of more than about 1% and random packing, almost independent of the length of the individual fibers, provided that the total distance between the working surfaces 14*a* and 14*b* is not large, say in the order of 1 cm or less, as is envisaged for this case of elastic brush body deformation and glueing. Similarly, under the same restrictions, the matrix materials in FIGS. 1*b* and 1*f*, for example, need not be electrically conductive. This affords the opportunity of using, say, fiber glass bodies reinforced with metal fibers formed in-situ with fibrous parts made by suitable means, e.g. etching or the application of electric or magnetic fields while the glass is soft, as described in methods 1, 5 and 6 for making fibrous parts.

FIG. 1*i* illustrates yet other possibilities for the practical application of the invention, namely that the matrix material in the brush body 10 could be an elastomer, in this case forming a belt passing around a object 16 with a rotational axis 22 to which the current is passed via the fibrous part 12 and the working surface 14. The object 8, through which the current is supplied to the brush body 10 may itself be supplied with current by the spring 32 that applies the desired tension to the brush body in the form of the belt as drawn. In this application, the brush body must have adequate conductivity for the intended purpose. If the major object of the arrangement should be to maintain reliable low-current contact with little or no noise between an object 16 subject to irregular movements and a stationary circuit where the currents are small such as in some guidance devices, the demands on the conductivity of the brush body would be quite modest. Advantageously, the electrical conductivity of the brush bodies can be raised by applying an electrically conductive surface coating, such as a metal plating, to the brush body (say, to that surface which faces away from the object 16, for example) or by raising the concentration of electrically conductive fibers in the matrix material.

In the arrangement drawn in FIG. 1*i*, the mechanical elasticity of the brush body 10 supplements the mechanical elasticity of the spring 32 to the effect that the brush load, and hence the pressure at any point of the working surface 14, is subject to smaller changes (e.g. as caused by vibrations or such as would be expected if the fibrous part should wear down somewhat or become matted) than would be the case without such elasticity of the brush body 10. Given sufficiently high rubber elasticity of the brush body 10, the spring 32 may be omitted entirely.

Figure 1K:
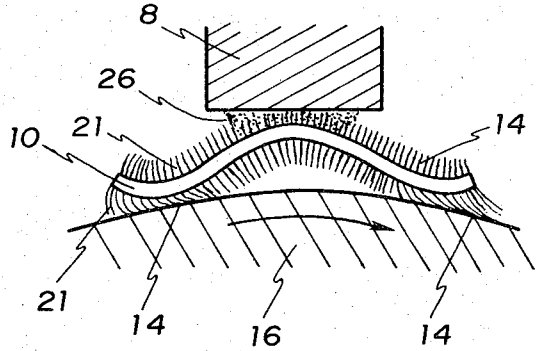
Figure 1J:
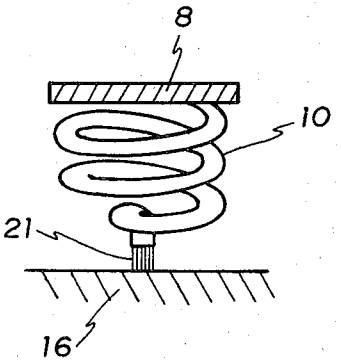

Other designs in which the elastic characteristics of the brush body are such as to either supplement or replace mechanical springs that otherwise would be used to apply the brush load are indicated in FIGS. 1*j* and 1*k*. These are meant to be examples indicating general principles, and are not meant to be exhaustive. In FIG. 1*j*, the brush body 10 has the shape of a spiral spring. In that case, the brush pressure is adjusted by suitably fixing the distance between the object 8 through which the current is supplied to the brush, and the contacted object 16 (of arbitrary shape, at rest or in relative motion, if desired). In the particular example of FIG. 1*j*, the brush is made out of brush stock in the form of a wire or rod with the embedded fiber wires 21 parallel to the wire axis. This is the type of arrangement in which methods 2, 3 and 4 of making fibrous parts on brush bodies, enumerated above, are conceived of as especially applicable, particularly if the vertical end piece of the spring, from which the fiber wires 21 are shown as protruding, is made of a length to yield a predetermined total life time of the brush. Alternatively, the vertical piece could be eliminated altogether and the brush be operated via mechanical and electrical contact between the momentary end of the helical windings of the brush body 10 and the object 16. In time, this end point would be gradually shifting on a spiral path upwards in FIG. 1*j*, as the brush wears. The upper end of the brush in FIG. 1*j* is attached to the object 8 by any suitable conventional means. Very commonly, object 8 will be a cable or a fitting to which a cable is attached.

The brush in FIG. 1*k* exemplifies the same general principles indicated in FIG. 1*j* but for the cse that the brush body 10 is made out of strip in the shape of a leaf spring, and that the fiber wires 21 are emerging in both directions from the brush body 10. In this design, again, it is not necessary that the matrix material be electrically conductive, as indeed is the case for all of the designs of FIG. 1 except probably FIG. 1*d* if used to conduct current from between objects 16*a* and 16*b*, subject to suitable considerations on sizes, fiber packing fraction, and current densities involved, with the particular proviso that it may be helpful or necessary to apply electrically conductive surface coatings to the brush body and/or to immerse it into an electrically conductive liquid, such as NaK, or Hg. The need for, or desirability of, electrically conductive surface coatings on brush bodies, especially but not exclusively in the form of a metal plating, have already been mentioned in connection with FIG. 1*i*. The usefulness of this strategem, plus that of using electrically conductive liquids in connection with fiber brushes in specific cases, shall be emphasized here, in general.

Specifically, in regard to the use of fluids in conjunction with electrical fiber brushes according to the invention, it may be noted that, for example, the space about the objects depicted in FIG. 1*k* could be usefully filled with NaK in order to enhance the current conduction between objects 8 and 16. Another use of fluids (meaning gases or liquids, electrically conductive or insulating, as may be deemed to be the most advantageous), may be clarified in relation to FIG. 1*b*. Namely, if the brush body 10 is made in the shape of a flexible membrane, i.e. much thinner and of relatively greater area than indicated in FIG. 1*b*, fluid pressure may be applied to the brush from behind, by means of excess pressure in the space between the object 8, the holding device 17, and the brush body 10 as compared to the pressure surrounding object 16. For a very flexible brush body this arrangement could be made to yield a substantially uniform brush pressure over an extensive area of the surface of object 16, if so desired; in that design, the brush pressure could be readily maintained constant in a wide range of levels, as desired. If in the described design the matrix material in the membrane forming the brush body 10 is electrically insulating, for example being rubber, an electrically conductive surface coating on the back surface of the brush body 10 in FIG. 1*b*, i.e. that facing object 8, might be needed to facilitate current conduction from object 8 via holding device 17 to the fibrous part 12*b*. Even more advantageous in cases would be the use of an electrically conductive fluid in the space between the brush body 10 and the object 8, which fluid applies the pressure. An additional substantial advantage of such a design is the fact that the fluid by which the brush pressure is applied can at the same time be used to cool the brush upon recirculation of the fluid. The fibrous part 12*a* may be omitted in the described modification of the arrangement of FIG. 1*b*, as desired. Also, the contacted object may be in relative motion, and it may be an object with rotational symmetry which is in a state of continuous or intermittent rotation.

In all cases in which objects of rotational symmetry are the contacted object, it is understood that these may be continuous along their circumference or segmented as a commutator. If commutators are used as the contacted object, care should be taken in regard to smoothness of the composite surface of the segments in order to prevent undue wear of the fibrous brush parts contacting the commutators. Also, direct curent may be conducted through the brushes, or alternating current, or variable currents.

It may further be noted that the brush body 10 in FIG. 1*h* may be given the indicated elastic deformation by differential pressure between the space between the brush body 10 and the object 8 as compared to the ambient pressure in the surrounding space, whereby the space between brush body 10 and object 8 may be partially evacuated, or the surrounding space be pressurized, for example. Again, the space between object 8 and the brush, and/or the space surrounding object 16, could be filled with an electrically conductive fluid to enhance conduction.

While FIGS. 1*j* and 1*k* use the examples of brushes in which the fibrous parts are consisting exclusively of fiber wires, this is not essential or necessary. Similarly, the fibrous parts in any of the other drawings of FIGS. 1*a* to *i* could consist exclusively of fiber wires of only one kind, or could include secondary, tertiary and/or support fibers. In general, the function of the fibrous parts 12, 12*a*, 12*b* and 12*c* is two-fold: To permit current conduction between the brush body 10 and the working surfaces 14, 14*a*, 14*b* and 14*c*, and, secondly, to impart, to the brush as a whole, resilience and compliance in depth such that the working surface will, in its microscopic behavior, act to let the fiber wires in the working surface make electrical contact with the object to which electrical connection shall be made.

The demands made on the mechanical properties of the fibrous parts of brushes tend to be more difficult to meet than the requirements on their electrical conductivity. The specific mechanical properties desired for any particular fibrous part depend on the specific conditions; including the size and surface roughness of the contacted object and also, importantly, the relative speed between brush and contacted object, and the ambient pressure. The relative speed together with the ambient pressure determine the amount of aerodynamic lift which tends to lift the fiber wires off the surface of the contacted object. This aerodynamic lift must be overcome by adequate brush pressure if the brush is to function properly, which, in turn, required sufficient stiffness of the fibrous part to withstand the brush pressure and/or aerodynamic lift. However, at any packing fraction, f, that one may reasonably except to achieve, say several percent for the thinnest fibers contemplated, the requisite stiffness for overcoming aerodynamic lift requires that $l/d \lesssim 200$, as may be seen from the theory in the appendix. Now, top performance of quantum mechanical brushes is theoretically expected for d in the order of 0.1 microns or even less, meaning that for brushes with rigid brush bodies at top performance the fiber wire length should be less than 0.02 mm. This is less than the surface roughness of many contacted objects, and is also less than the typical eccentricity of rotors, slip rings and commutators, and is less than the accuracy with which rigid surfaces of macroscopic sizes (i.e. in the order of 1 $cm^2$ or more area) can be aligned without undue problems.

Two major approaches have been chosen in the present invention to overcome this difficulty: Firstly, by a system of tertiary and/or secondary fibers in conjunction with fiber wires in the fibrous parts of brushes, one may achieve independent control of the fiber wire diameter and the thickness and stiffness of the fibrous parts, within very wide limits of fiber wire diameters. Secondly, by making the brush bodies very compliant, the demands made on the mechanical properties of the fibrous parts may be reduced. Depending on conditions, one or the other approach will be the more satisfactory, and on occasion a combination of both may be best.

Figure 7A:
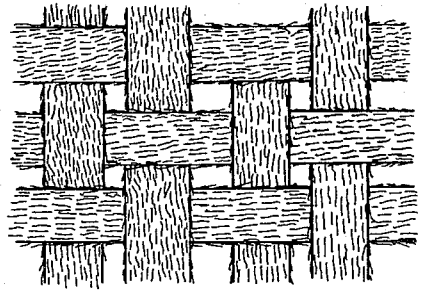
FIGS. 7*a, b,* and *c* are schematic views of electrical fiber brushes in the form of material woven from multifilamentary ribbons or threads, etched or otherwise treated to generate fibrous surfaces on them.
Figure 7C:
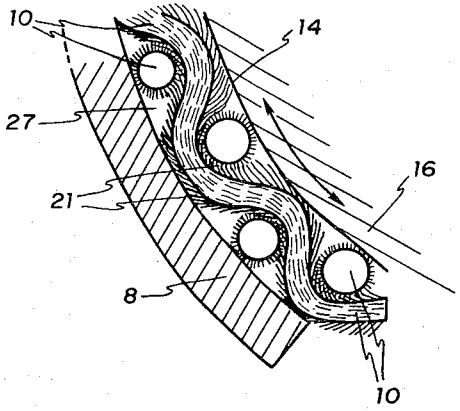
Figure 7B:
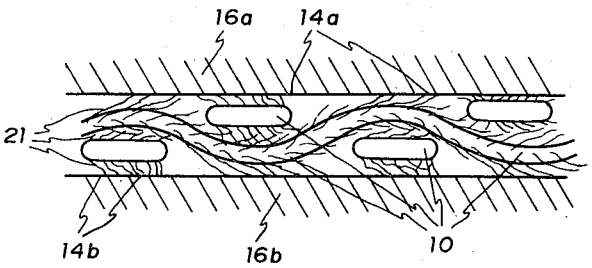

FIGS. 3*a*, 3*b* and 4*a* to 4*g* illustrate constructions of the fibrous parts of brushes devised to accomodate the discussed requirements on the mechanical properties of fibrous parts, whereas FIGS. 7*a* to 7*c* specifically relate to means for making compliant brush bodies by the use of textile technology methods, supplementing the methods already discussed in conjunction with FIGS. 1*b*, 1*i* and 1*h* above.

FIGS. 4*a* to 4*f* show schematic crossections through fibrous parts of brushes. These fibrous parts extend from the brush body 10, being limited by the interface 23, on the side of the brush body, and by the working surface 14 on the side of the object 16 to which electrical connection is made. In each case the length of the fibers in relation to their diameter is typically, but not necessarily, longer than to scale in FIGS. 4*a* to 4*f*, which fact has been indicated by appropriate break lines. The interface 23 between the brush body 10 and the fibrous part of the brush is shown as the straight line terminating the brush body 10 at its bottom. In actual fact it will rarely, if ever, be as straight as indicated, nor will the fibers be of as uniform spacing and diameter as indicated in the idealized schematical rendering of FIGS. 4*a* to 4*f*.

The packing fraction, f, is defined with respect to the interface 23. Operationally, f may be determined as follows: By means of polishing paper remove all the fibers from the brush body and take a micrograph of the interface 23. By means of a planimeter measure the fraction which, in that micrograph, the crossections of all of the fiber wires (of the set under consideration, within a given area of the interface 23) form of the total area of the interface examined, that area being chosen to be representative of the average structure of the interface, and chosen to be large compared to the crossectional area of the single fiber wires as well as the distances between the fiber wires. In like manner the packing fractions of the secondary fibers ($f_s$) and of the tertiary fibers ($f_t$) can be determined, wherein the crossectional area of the individual secondary and/or tertiary fiber is taken to be that within the outer circumference of the respective fibers as seen on the discussed micrograph of the interface 23. The packing fraction of the fiber wires in the working surface of the brush is not well defined and may differ from the packing fraction in the interface 23, determined according to the above definition, but generally not by factors far from one. In the theory, such differences are expressed in terms of the parameter $\alpha$ which is the number of a-spots per fiber wire. Although the precise definition of f is as given, in the typical case f is at the same time nearly equal to the fraction which the total crossectional area of the fiber wires in the fibrous part of the brush, when measured parallel to the working surface and at a distance d from the working surface, represents the total crossectional area of that working surface.

Concerning the possible structures of the fibrous parts of brushes, FIG. 4*a* shows the simplest possible case, namely that of only one set of fibers, these being the fiber wires 21 of crossection d and average exposed length l, meeting the object 16 at the working surface 14 and emerging from the brush body 10 at the interface 23. In FIG. 4*b* there is shown the case of one set of secondary fibers 20 of diameter $d_s$ and length $l_s$, from which secondary fibers extend the fiber wires of exposed length l. In FIG. 4*c*, there are shown tertiary fibers 18, of diameter $d_t$ and length $l_t$, from which are extending secondary fibers of diameter $d_s$ and exposed length $l_s$, from which secondary fibers extend the fiber wires 21 of exposed length l. FIG. 4*d* illustrates the case of secondary fibers 20 and fiber wires 21 plus support fibers 24 which are shorter than $l_s+l$, i.e. shorter than the sum of the exposed lengths of the secondary fibers and the fiber wires, such that the support fibers do not touch the object 16 unless the fiber wires and secondary fibers are bent. As is further clarified in the theory presented in the appendix, the cumulative mechanical stiffness of the secondary fibers together is proportional to $E_s f_s(d_s/l_s)^2$, and simiarly the cumulative stiffnesses of the tertiary fibers and fiber wires are proportional to $E_t f_t(d_t/l_t)^2$ and $Ef(d/l)^2$, respectively, these stiffnesses being approximately proportional to the force that is needed to bend the named sets of fibers through the same angles and thereby to shorten the distance between their endpoints by the same percentages, wherein E, $E_s$ and $E_t$ are the effective values of Youngs modulus for the fiber wires, the secondary fibers, and for the tertiary fibers, respectively. Therefore, if a fibrous part should be constructed to have a total thickness of $l_t+l_s+l$ and such that $Ef(d/l)^2=E_s f_s(d_s/l_s)^2=E_t f_t(d_t/l_t)^2$ then the applicationof a certain brush pressure would bend all fibers through about the same angle, provided that this angle is small, i.e. does not exceed several degrees. As a result, under the action of a suitable brush pressure, the total compliance of the fibrous part in the direction of the fibers would be some specific percentage of the total length $l_t+l_s+l$, which can be many times larger than l, and thus the needed resilience and compliance in depth, that has been discussed above, can be achieved.

The function of the support fibers is to provide protection from accidental mechanical damage, being dimensioned to make contact with the object 16 only when the brush is mechanically overloaded. Alternatively, the support fibers may be made of a low-friction material, such as graphite or telfon, and the brush may be operated with the support fibers in permanent contact with the object 16, thereby acting as spacers to insure a predetermined bending of, and thus a predetermined force acting on, the fiber wires.

Figure 4F:
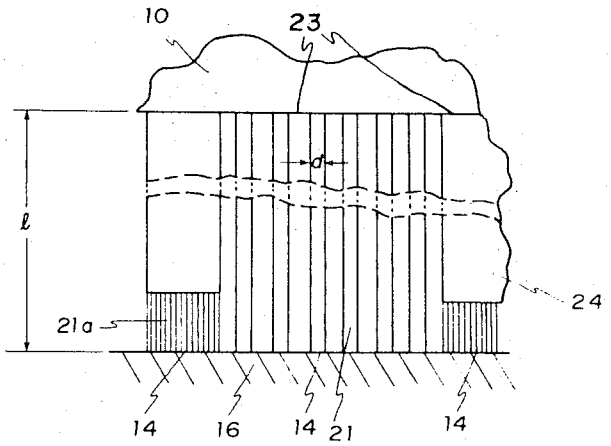
Figure 4E:
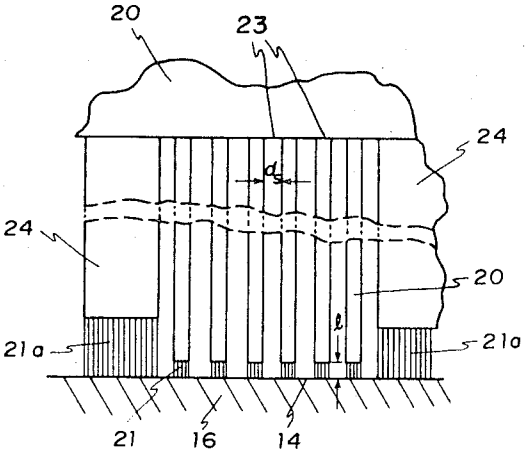

A refinement of the first of these concepts, in which the support fibers serve to protect the fibrous part of the brush from accidental damage, is illustrated in FIGS. 4*e* and 4*f*, in which the support fibers 24 are provided with thin conductive fibers 21*a* extending from them to supplement the electric conduction through the fiber wires 21 when the brush is in normal operation. Namely, in FIGS. 4*e* and 4*f* the fibers 21*a* are envisaged to be so long as to make contact with the object 16 whenever the fiber wires 21 make contact with object 16. This is not necessary, however, and instead the fibers 21*a* could be shorter to make such contact only when the brush is overloaded, in which design the fibers 21*a* would serve only as a kind of backup system.

It should be noted that the aerodynamic lift acting on fiber brushes when in relative motion to the contacted object depends on ambient pressure and is reduced when the ambient pressure is reduced, such as would be the case for fiber brushes operating in high flying aircraft or in satellites, unless artificially pressurized. For the performance of fiber brushes reduction of ambient pressure is thus beneficial.

Figure 3A:
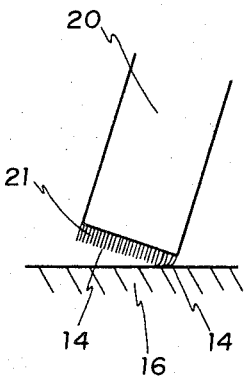
FIGS. 3*a* and 3*b* are schematic representations of the geometry of fibers wires of different lengths protruding from secondary fibers while the secondary fibers are inclined with respect to the object to which electrical connection is to be made, e.g. either because the brush is tilted as in FIG. 2, or because there is relative motion between the brush and the contacted object, or because the fiber is bent elastically due to applied load, or a combination of these.
Figure 3B:
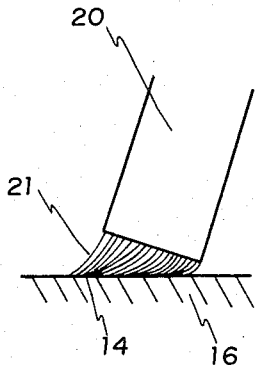

One further point needing discussion is the relationship between the length of fiber wires extending from secondary fibers in relation to the diameter of the secondary fibers. This is clarified in FIGS. 3*a* and 3*b*. FIG. 3*a* shows fiber wires 21 extending from a secondary fiber 20, wherein the length of the fiber wires is significantly shorter than half of the diameter of the secondary fiber. As indicated, in the case of so short fiber wires a substantial number of fiber wires 21 are lifted off the object 16 to be contacted when the end of the secondary fiber 20 is tilted with respect to the surface of object 16, to the effect that a substantial fraction of the fiber wires 21 in the working surface 14 are not in contact with the object 16, a condition which will result in an increase of brush resistance. This problem is ameliorated if the exposed length of the fiber wires 21 is increased, say to be comparable to, or larger than, half of the diameter of the secondary fibers, the exact relationship for optimal brush performance in this regard somewhat depending on the relative stiffnesses of the set of secondary fibers as compared to that of the fiber wires, on the magnitude of the brush pressure, on the surface roughness of the contacted object, on the strength of the aerodynamic lift, and on still other factors.

Figure 4G:
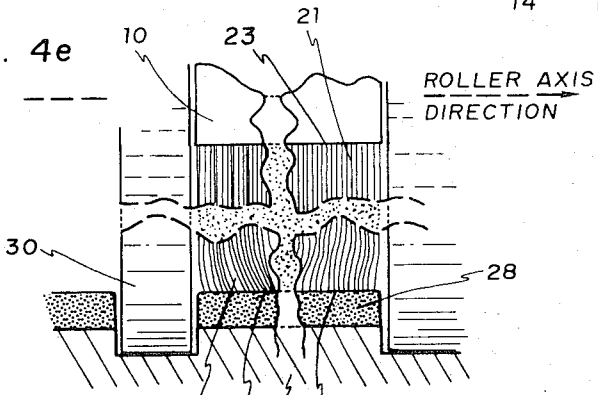

An extension of the concept of support fibers is illustrated in FIG. 4*g* in which the support fibers are replaced by two rollers 30 whose axis is parallel to the local surface of the contacted object 16 and such that the fiber wires 21 are bent to a predetermined degree and/or in a predetermined manner when the rollers are in firm mechanical contact with the surface of the object 16. In this manner the rollers 30 serve the function of spacers to assure the mentioned predetermined bending, and thus assure mechanical loading of the fiber wires in a favorable range to yield good electrical contact without unwanted mechanical damage to the fibers. In FIG. 4*g*, it is envisaged that there are no tertiary and/or secondary fibers in the fibrous part of the brush. This is not a necessary, or even a desirable, restriction, but in general all types of fibers may be used in conjunction with such rollers. In case the brush is used at rest, such as in a switch, the rollers may be replaced by other rigid objects to serve the discussed function of spacers. Also, neither the rollers nor the rigid objects that may be used in the place of rollers for the same purpose, need to be fixed to the brush body and/or any object rigidly connected to the brush body, but instead these rigid objects or rollers may be rigidly fixed to the contacted object in a manner to make mechanical contact with the brush body or an object rigidly connected thereto when the fiber wires are bent in a predetermined manner and/or degree.

The use of rollers or other rigid objects, electrically conductive or insulating, to serve as spacers as described, can on occasion be made more effective in terms of better electrical conduction through the brush or in terms of less brush friction, brush wear and/or wear of the contacted object 16, if that object 16 is specifically designed to accommodate fiber brushes with such rollers or other rigid spacers. Such accommodation can take the form of using two or more different materials at the surface of object 16, thereby providing extra hard or low-friction tracks for the rollers and other rigid objects, for example, or of providing particular surface coatings to achieve low film resistance where the fiber wires make electrical contact with the object to be contacted. Such different materials, tracks and/or other surface contours may be achieved in various ways, among these the preferential application of surface coatings, such as platings, or layers deposited by dipping, painting, plasma deposition, evaporation, sputtering, spraying or any other suitable means. Alternatively, the discussed surface modifications may be made by preferential removal of material from the surface of object 16, such as through preferential etching, mechanical removal and/or any other suitable means. In FIG. 4*g* a combination of both partial application of a surface layer and partial removal of surface material from object 16 is illustrated. The number of rollers and/or rigid objects to serve as spacers is optional and may be adapted to the particular circumstances at issue in any one particular case.

Above, mention was already made of the option of making the brush body very flexible, thereby creating conditions in which even rather short fiber wires can perform satisfactorily, for the reason that the brush body can then at least partly conform to the contours of the surface of the object to which electrical contact shall be made. Examples of this option have already been discussed for the case that the brush body is given the shape of a flexible sheet, film, strip or membrane. Under the most favorable conditions, even better flexibility of the brush body can be achieved by making use of techniques of textile technology including weaving, felting and knitting, making possible, among other advantages, simplicity of application and considerable adaptibility of this kind of brush to a wide range of circumstances.

FIGS. 7*a* to 7*c* show examples of fiber brushes according to the invention whose manufacture included a weaving process. In FIG. 7*a* there is shown a top view of a fiber brush according to the invention in which the brush body has the shape of a simple weave out of fibers or elements with flattened crossection. A section through this brush is shown in FIG. 7*b*, representing the view of the brush of FIG. 7*a* when it is sectioned in a horizontal line on the drawing of FIG. 7*a* between two horizontal elements, such that only the vertical elements are seen as cut in the view of FIG. 7*b*. The fiber wires 21 forming the working surfaces 14*a* and 14*b* of the brush are seen to be somewhat irregularly shaped and spaced, in this example. This is a condition that would be expected to arise if the fibrous part of the brush is made by applying an electric field or a magnetic field to the brush stock while the matrix is softened by heat (in the latter case requiring that the fibers have magnetic properties) in the manner of methods 5 and 6 previously explained. Or else the fibrous parts on the elements making up the brush body 10 in FIGS. 7*a* and 7*b* could be made by method 7, or also by method 1, or perhaps a combination of any of these.

Note also that the fiber wires in FIGS. 7*a* to 7*c* are inclined at an angle to the working surface as well as the brush body parts from which they variously extend. This, too, is a condition that will be produced by methods 5 and 6 of making fibrous parts and, indeed, the orientation angle between the majority of the fibers in the fibrous part as compared to the direction of the fibers in the brush body can be somewhat regulated by these methods. While the irregularity of spacing and of the fiber shapes, to which reference was made already, is of not much importance for the behavior of the brush, the possibility to predetermine the angular orientation of the fibers in the fibrous part, at least somewhat although not precisely, is a great advantage of these methods of making fibrous parts. Namely, for a variety of purposes, it is advantageous that the fiber direction within the brush body be generally along a long direction of the brush body, e.g. the long direction of the belt in FIG. 1*i*. Namely, in that orientation they tend to make an optimal contribution to the strength as well as the electrical conductivity along the brush body. On the other hand, within the fibrous part of the brush, a fiber orientation parallel to the interface 23 between brush body and the fibrous part is typically very disadvantageous. Not only that the current path through the fibrous part is unnecessarily long in that case, and that the number of a-spots per unit area of working surface will be unnecessarily low since many fibers will then pack together on top of each other rather than ending on the surface of object 16, but the mechanical behavior of the fibrous part will also not be favorable. The situation shown in FIGS. 2*a* and 2*b* is usually the most desirable, in which the fibers make an intermediate angle with the contacted surface. In that general orientation, the compliance and resilience of the fibrous part is very good, and, in case of relative motion, the brush tends to operate smoothly. The best choice of angle $\theta$ or $\Psi$ (of FIGS. 2*a*, and 2*b*) will depend on detailed circumstances, but at any rate, choosing these angles near 90°, meaning that the fibers are substantially parallel to the working surface, is undesireable. In summary, therefore, the orientation angle between the fibers in the body of the brush and the fibers in the adjoining fibrous parts (when not in contact with any object) should best lie between, say, 10° and 170°.

In FIG. 7*b* a possible use of the brush of FIGS. 7*a* and 7*b* is shown, namely being used to establish electrical contact between the two objects 16*a* and 16*b*, both with flat surfaces and relatively at rest. If used in this manner, the brush could greatly simplify certain constructions in which otherwise soldering might be used to establish good electrical contact. Incidentally, this configuration will yield good thermal contact at the same time.

FIG. 7*c* presents another example of a woven brush body, but in this case made of elements with circular crossection. The example of FIG. 7*c* contemplates an application of the brush which is at this time the perhaps most common application of all electrical brushes, namely that of conducting current to or from a slip ring or commutator, as is also shown in FIGS. 2*a* and 2*b*. However, there are manifold other possible applications of woven electrical brushes, one of these being that depicted in FIG. 1*i* in which the brush body, instead of being made of an elastomer, for example, could be of the types shown in either FIGS. 7*a* and 7*b*, or in FIG. 7*c*. Instead of being regularly assembled, as in the examples of FIG. 7, the elements of which the weaving is composed could instead be assembled in a less regular fashion in the form of a felt. Similarly, instead of being woven, the brush body could be knitted, and if desired the brush body could be sewn together out of two or more pieces, not necessarily of the same kind, to generate more complicated shapes as may be needed in specific cases. Also, it is perfectly well possible, and may in cases be very advantageous, not to provide fibrous parts on all of the elements in the woven, felted or knitted brush body. Further, the fibrous parts may comprise secondary and/or tertiary fibers besides fiber wires, and it is not necessary that the matrix material be electrically conductive. Considerations of cost, mechanical strength, mechanical wear, weight, permissible brush resistance, peak current density, and many others, will determine from case to case which are the most desirable choices of materials and of construction to be employed in making electrical fiber brushes by the use of textile technological processes. In this connection FIG. 7 is thus meant only to give examples, besides clarifying the general principles involved.

Having by means of FIGS. 1, 4 and 7 outlined the very wide variety of shapes in which the fiber brushes according to the invention can be made, as well as the materials choices and some of the large number of applications and uses, the following sections will consider the basic mechanical and electrical properties of the fibrous parts and of the working surfaces, respectively, in greater quantitative detail, where also some examples of making specific fibrous parts, including fiber wires, secondary fibers and tertiary fibers, will be given.

(a) Only One Set of Uniform Fiber Wires in the Fibrous Part of the Brush—Metallic Matrix For this case (schematically depicted in FIG. 4*a*) most of the considerations regarding choice of materials, barrier materials, making the brush stock, shaping the brush, and etching apply as in the patent application by D. Wilsdorf et. al. U.S. Patent Application Ser. No. 138,716, filed on Apr. 9, 1980 and entitled "An Electric Brush and Method of Making". Additionally, if the fiber length is small compared to the smallest dimension of the brush stock, and etching is done by dipping into a suitable etchant, the level to which the brush stock is dipped into the etchant is generally not critical.

As a specific example for a brush with one set of uniform fiber wires according to the invention, one may name a brush made with gold fibers in a copper matrix with $d=10\ \mu m$, $f=30\%$, and $l=1$ mm. Past experience making metal fiber brushes with $6.6\ \mu m \lesssim d \lesssim 100\ \mu m$ and $2.9\% \lesssim f \lesssim 20\%$ indicates that such a brush can be made without undue difficulty and can be run at a pressure of $p_B=5000\ N/m^2$. At the film resistivity previously determined for gold on copper in clean conditions, namely $\sigma_F \simeq 1\times10^{-12}\ \Omega m^2$ and assuming $\alpha=1$, FIG. 5 predicts $R_B A_B \simeq 1.2\times10^{-8}\ \Omega m^2$ or $l_{eq} \simeq 65$ cm, while from equation 7 with $V_{crit} \simeq 0.3$ V, one finds* $J_{max} \simeq 2\times10^7\ A/m^2$. The example is but one of a very large array of possible brush designs and materials choices and is not meant to be inclusive.

*For theory and calculations see the appendix.

(b) One Set of Secondary Fibers with Fiber Wires Protruding Therefrom—Metallic Matrix The case of fiber wires 21 protruding from secondary fibers 20 which protrude from the solid part of the brush 10 is schematically depicted in FIG. 4*b*. A possible example here would be gold fiber wires protruding from secondary copper fibers which, in turn, protrude from an aluminum matrix. Two sets of possible values characterizing two different brushes in the manner of Table A in the appendix are listed below in Table I.

TABLE I

| | BRUSH A (Aluminum Matrix) | | BRUSH B (Aluminum Matrix) | |
|---|---|---|---|---|
| | Fiber Wires | Secondary Fibers | Fiber Wires | Secondary Fiber |
| Material | gold | gold fiber wires embedded in copper | gold | gold fiber wires embedded in copper |
| Average Diameter | $d = 1\ \mu m$ | $d_s = 15\ \mu m$ | $d = 0.2\ \mu m$ | $d_s = 15\mu$ |
| Average Length | $l = 50\ \mu m$ | $l_s = 1.5$mm | $l = 5\ \mu m$ | $l_s = 1.5$mm |
| Aspect Ratio | $l/d = 50$ | $l_s/d_s = 100$ | $l/d = 25$ | $l_s/d_s = 100$ |
| Number in group, $N_s$ | 50 | — | 375 | — |
| Total number in brush of $A_B = 1cm^2$ | $8.5 \times 10^6$ | $1.7 \times 10^5$ | $6.4 \times 10^7$ | $1.7 \times 10^5$ |
| Packing Fraction, f | $0.3 \times 0.22 = 6.7\%$ | 30% | $0.3 \times 0.067 = 2\%$ | 30% |
| $f_i(d_i/l_i)^2$ | $2.7 \times 10^{-5}$ | $3 \times 10^{-5}$ | $3.2 \times 10^{-5}$ | $3 \times 10^{-5}$ |
| $d/f^3$ | $6.1\ \mu m$ | | $2.7\ \mu m$ | |

The above examples were chosen because it is confidently expected that they can be made in the laboratory using the drawing and rebundling techniques for making metal fiber brushes described by D. Wilsdorf et. al. U.S. Patent Application Ser. No. 138,716 of Apr. 9, 1980. In the case of brush A one would make, say, a composite wire in which 50 gold wires of average diameter 0.3 mm are embedded in a copper matrix encased in a copper tubing drawn down to an outer diameter of 4.5 mm. The composite wire would then be encased in aluminum tubing and drawn down with intermediate rebundling in aluminum as needed until the diameter of the copper filaments, now embedded in aluminum, had been reduced to $\sim 15\ \mu m$ at which point the gold fiber wires would be reduced to $\sim 1\ \mu m$.

In the case of brush B, instead of preparing copper tubing with copper and gold wires embedded in it as described for Brush A, one might begin with a thin-walled copper tubing filled with an appropriate mixture of compacted gold and copper powder composed of spheroidal particles with diameters in the range of 10 $\mu m$, which on drawing down would become filamentary, whereby at an average diameter of 0.2 $\mu m$ the average (unbroken) filament length would be in excess of 1 cm (compare P. Haasen and L. Schultz, op. cit.). For both brush A and brush B, etching, performed after shaping the working surface of the brush, would probably best be done by first removing a surface layer of copper (of thickness $l=50\ \mu m$ or $l=5\ \mu m$, respectively), by etching in nitric acid, leaving the aluminum intact, and then removing 1.5 mm of aluminum from the brush stock with, say, 20% NaOH in water, using any of the methods described in the mentioned U.S. Patent Application by D. Wilsdorf et. al. Alternately, the gold fibers could perhaps be etched out of the copper by selective sputtering, before or after removal of the aluminum.

(c) One Set of Tertiary Fibers with Secondary Fibers from which Fiber Wires are Protruding—Metal Matrix This case is a further elaboration of the case discussed in section b above. For example, a brush with fiber wires, secondary fibers and tertiary fibers could be formed from brush stock similar to that for brush A of Table I above but substituting drawn-down aluminum tubing filled with a mixture of aluminum and gold powder for the gold fiber wires. The parameters might be chosen as listed in Table II. Again, in this example, drawing of powders or of directionally cooled alloys, i.e. the mentioned formation of fibers "in situ", is envisaged to give the very fine fiber wire sizes that are otherwise difficult to obtain (compare for example Haasen and Schultz, op. cit. and Bevk and Karasek, op. cit.).

TABLE II

| | Fiber Wires | Secondary Fibers | Tertiary Fibers |
|---|---|---|---|
| Aluminum matrix | Gold | Compacted gold and aluminum powder drawn in aluminum tubing | Secondary fibers embedded in copper |
| Average diameter | $d = 0.1\ \mu m$ | $d_s = 10\ \mu m$ | $d_t = 100\ \mu m$ |
| Average length | $l = 10\ \mu$ | $l_5 = 1mm$ | $l_t = 1.5cm$ |
| Aspect ratio | $l/d = 100$ | $l_s/d_s = 100$ | $l_t/d_t = 150$ |
| Number in group | $N_s = 2400$ | $N_t = 24$ | — |
| Total number in brush with $A_B = 1cm^2$ | $1.8 \times 10^8$ | $7.4 \times 10^4$ | 3055 |
| Packing fraction | $(0.24)^3 = 1.4\%$ | $(0.24)^2 = 5.8\%$ | 24% |
| $f_j(d_j/l_j)^2$ | $1.4 \times 10^{-6}$ | $5.8 \times 10^{-6}$ | $1.07 \times 10^{-5}$ |

(d) Brushes with Support Fibers or Other Mechanical Support

A novel strategy for making metal fiber electrical brushes as serviceable and rugged as possible has already been explained with reference to FIGS. 4*d* to 4*g*. The support fibers 24 are thicker than the fiber wires 21 and/or the secondary 20 and/or tertiary fibers 18. In one version their length is made equal to the minimum safe distance between the solid part of the brush 10 and the contacted object 16. If the forces on the brush, overall and/or locally, exceed the safe level, the support fibers begin to support an increasing share of these forces, thereby protecting the current-carrying fibers from damage. As an example, consider fiber wires of diameter $d=15\ \mu m$, $l=2$ mm and packing density $f=18\%$. For these, all together, the stiffness is proportional to $f(d/l)^2=1\times10^{-5}$ (compare equation 15). Adding support fibers with similar Young's modulus with $d_F=200\ \mu m$, $f_F=2\%$ and a slightly shorter length, say, $l_F=1.6$ mm yields $f_F(d_F/l_F)^2=3.1\times10^{-4}$, i.e. increases the stiffness roughly thirty-fold, once the safe brush load is significantly exceeded. It is not necessary to distribute the support fibers randomly or on a regular grid but they might, for example, be arrayed about the circumference so as to permit the greatest possible freedom of motion to the fiber wires.

A practical example for FIGS. 4*d, e* and *f* might be as follows: fiber wires 21 consisting of gold or a platinum group metal, secondary fibers 20 consisting of aluminum, except for the fiber wires in them, (or consisting of copper, or indeed any of a wide variety of other suitable metals, covered with a 1 $\mu m$ thick aluminum barrier), support fibers 24 consisting of silver, except for the fiber wires in them (or consisting of copper or any of a wide variety of suitable metals covered with a silver barrier of, say, $\geqq 10\ \mu m$ thickness), matrix material in the solid part of the brush consisting of copper.

After forming and shaping the brush stock, one may make the fibrous part by first etching away to the intended length of the fiber wires a surface layer of all but the noble metal fiber wires, using 50% $HNO_3$ in water followed by a similar etch in 20% NaOH in water, or invert the order of these etching steps as convenient and most suitable. Next one may remove the copper matrix material to the depth of the intended length of the secondary fibers (which is probably best done in the centrifuge as taught in U.S. Patent Application Ser. No. 138,716 by D. Wilsdorf et. al. filed Apr. 9, 1980) using saturated $FeCl_3$ in water at 80° C., followed by removal of a suitable length of the support fibers (probably again in the centrifuge) using $HNO_3$. The etching agents named are those listed in the cited U.S. Patent Application by D. Wilsdorf et. al.

The outer layers of secondary and tertiary fibers need not be made of metal, and even less so support fibers, except for the current-carrying filaments 21*a* projecting from them, if any. Thus support fibers could, for example, be made of graphite (or carbon), or teflon, or nylon, or any other material that may serve the intended purpose. Many of such fibers can be etched or dissolved to be made shorter than the current-carrying fibers and thus to operate in the same manner as described already. An alternative option is to let all fiber wires and support fibers terminate at the same level but to arrange the support fibers so as to let them run in separate tracks from the fiber wires, which tracks form depressions in the rotor or slip ring or other surface to be contacted, such as to elastically bend the fiber wires in a favorable manner, as indicated for the case of rollers in the place of support fibers in FIG. 4*g*. The advantage of such an arrangement is that brush load and coefficient of friction can be adjusted somewhat independent of the load carried by the fiber wires. Alternatively, plating may be added on those areas of the contacted object where the fiber wires will touch.

In case of relative motion the support fibers 24 may be cylindrical in shape, and be arranged in one or more rows parallel to the direction of relative motion, each row associated with one groove in the surface of the contacted object, or they may have the shape of sheets, i.e. being elongated in the direction of motion, wherein their edges which are in contact with the object 16 may be shaped in conformity with the grooves' cross-section, i.e. rectangular (as in the grooves in FIG. 4*g*) or rounded, as the case may be, as well as in conformity with the grooves' contour in the direction of relative motion (i.e. circular in the case of a rotor or slip ring).

The same design can be used also with metallic support fibers, e.g. carbon steel used in conjunction with noble metal fiber wires 21. The advantages in that case could be, for example, that the coefficient of friction and wear is lowered, that the load on the fiber wires is conveniently maintained, and that the fiber wires can be made more delicate and with less use of precious metal, than if the whole brush load rested on the fiber wires. A major function of the support fibers 24 in that case is insuring a desirable elastic bending of the fiber wires.

This same principle is equally applicable, for much the same reasons, in stationary applications and, as indicated already, with metallic as well as non-metallic support fibers.

Especially in heavy duty applications, the support fibers may be replaced by rollers. In this case, the rollers may run in tracks, as envisaged in FIG. 4*g*, or elevated, but in each case such that when the rollers touch the object to which electrical connection shall be made, then the fiber wires are bent in a predetermined manner. Similarly, the rollers could also be attached to the object to be contacted; in that case the rollers would be arranged to contact the brush or an object electrically connected to it when the fiber wires are bent by a predetermined amount, as already discussed in conjunction with FIG. 4*g*.

The tracks for support fibers or rollers, whether forming depressions or elevations in the object to be contacted, may be generated by mechanical means, e.g. via removal of material, or by physical, electrochemical or chemical means, e.g. via etching or selective plating, or by a combination of these. FIG. 4*g* assumes a combination of selective plating and removal of material. Plating has the advantage that a thin noble metal plating may be used at low cost.

In the static case, in which no preferred direction exists in the interface between the working surface of the brush and the contacted object, such as otherwise is given by the direction of relative motion, the support fibers and the associated grooves or tracks, if any, may have any desired patterns and shapes as deemed appropriate and desirable from case to case.

(e) Metal Fiber Electrical Brushes Made from Powders or Other Multiphase Materials The methods of forming fine fibers "in situ", from powders or alloys in which the intended fiber wire material constitutes a separate component, referred to above, provides a very simple method of making brushes. According to this novel method, the initial composite material (in which the intended fiber material is present as a finely separated phase, either as powder particles, or as directionally grown eutectic or as a eutectoid, or as a segregated phase, or a metal filling in glass tubing, for example, or other, compare Haasen and Schultz, op. cit.) is extruded or in any other way shaped and/or rebundled until the outer dimensions have attained the intended diameter of the brush stock, and the particles of the fiber wire material have attained their intended diameter and length. From that brush stock a piece is cut, and shaped, and then matrix material is etched out, is dissolved away, or is in any other manner removed as outlined in methods 1 to 7 on pp. 14 to 16, to form the fibrous parts of the brush stock.

For brushes used in the manner of FIGS. 1*b*, 1*c*, 1*e*, 1*f* and 1*h*, in which the current enters the same fibers at one end and leaves them at the other end, the matrix material could well be an insulator, e.g. glass or an insulating plastic. At any rate, whether the matrix material is a metal, ceramic or polymer, electrically conductive or not, brush stock in the form of sheets with fibrous layers on opposite sides offers the opportunity of making very versatile brushes inexpensively in the form of thin chips or membranes. Brushes according to the invention may be attached to either a stationary or a moving part of a circuit by very simple means, e.g. by screws, by simple mechanical holders (as in FIGS. 1*b*, 1*c* and 1*f*), by soldering (FIGS. 1*g* and 1*k*), or by a bead of glue about the circumferences (as indicated in FIG. 1*h*, for example) or by other methods, including magnetic action.

Hot extrusion of mixtures of glass and metal powders is expected to provide a method for future inexpensive mass production of brush stock. Etching of such brush stock may be done with $H_2F_2$. Namely, successful extrusion of glass/metal powder mixtures such that the metal particles are elongated into fine filaments has recently been demonstrated by G. Wasserman and coworkers for the case of aluminum (see H. W. Bergmann, B. L. Mordike and G. Wassermann, "Verbundwerkstoffe," Conference German Society for Metallurgy, Deutsche Gesellschaft für Metallkunde, Konstanz, Apr. 17–18, 1980). The underlying principle has been known since 1924 when G. F. Taylor, (Phys. Rev. 23, 1924, PP. 655–660) made very fine metal wires by filling quartz or glass tubing with metal and drawing it, while hot, through a conical hole in a copper block. By subsequently etching away the glass with hydrofluoric acid, Taylor thus made very thin wires of Cu, Ag, Au, Pb, Sn, Cd, Th, Fe, Co, Ca, In, Bi and Sb.

Should metal fibers be similarly producible by extruding powder mixtures of metal and suitable plastics, the resulting material should also be very suitable for making brushes, and at any rate extruded mixtures of metal powders are most promising for manufacturing fiber brushes.

On the basis of theory, brushes made from material with "in situ" formed filaments as indicated could be extremely effective. Assuming, for example, filament diameters of $d=0.1\ \mu m$, at a packing fraction of $f=3\%$, with $\sigma=10^{-12}\Omega m^2$, a brush of $A_B=1\ cm^2$ could have a resistance of as little as $R_B=1.6\times10^{-5}\Omega$ according to equation 3 for $\alpha=1$, or $R_B=5.3\times10^{-6}\Omega$ for $\alpha=3$ so that, using the brush as indicated in FIGS. 1*f* and 1*h*, for example, the total transfer resistance through the brush might be as low as $2.1\times10^{-5}\Omega$, with $J_{max}=18{,}000A/cm^2$ for $V_{crit}=0.3$ V according to equation 7. At higher packing fractions, on account of frequent mutual contact between adjoining fibers, the described glass-metal fiber and plastic-metal fiber composites would become overall electrically conductive, in which case also brushes of the type, FIG. 1*a, c, d,* and *g* could be made from these. Furthermore, according to Bergmann et. al. (op. cit) a 50%/50% glass-metal powder mixture can be extruded, at least for the case of aluminum/glass, which is a mixture that almost certainly has a high electric conductivity. If so, this offers the likelihood that 47% Cu, 50% glass and 3% Au can be extruded together which after etching away a layer of glass with $H_2F_2$ and the protruding Cu with $HNO_3$ should leave a layer of gold fibers on a conductive Cu-glass mixture. Alternatively, gold and copper powder mixtures could be extruded without any glass, the advantage of the mixture with glass presumed to be primarily one of cost. Furthermore, the use of metal-filled glass tubing spun into fibers or extruded, i.e. essentially the method of Taylor (op. cit.) should be widely applicable for the present purpose, being in fact one particular type of "in situ" formation of fibers. At elevated temperature, thin chips of glass, plastic, rubber or other non-metals, containing parallel metal fibers as described, could also be bent about an angle (e.g. as indicated in FIG. 1*g*), or could be smoothly bent to conform to the curvature of a slip ring (FIGS. 1*h* and 1*i*) either elastically or plastically. The same deformation could be effected at room temperature or elevated temperature also if the matrix is of metal.

For fiber lengths less than, say, 0.3 mm, etching can best be done simply by immersion in a suitable etchant, whereby in case any dimension of the working surface of the brush is not very large compared to the fiber length, the circumference of the brush body should be protected as, for example, with a lacquer. If used at rest (such as in a switch operated by opening and closing a gap, as in the geometry of FIG. 1*b*, say), the force on the brush could or should be such as to cause buckling of the average fiber, i.e. $p_B \gtrsim 4F_c f/\pi d^2$ or $p_B \gtrsim \pi^2 f d^2 E/64 l^2$ according to equation 14. With $f=3\%$, $d=0.1\ \mu$ $A_B=1\ cm^2$ and $l=0.1$ mm, the force to close the switch would then be 0.05 N, i.e. the weight of a postcard. With $l=0.03$ mm, the force would correspondingly be ten times larger, i.e. about two ounces, and with $f=0.2$ and $l=0.03$ mm the force would be about three-quarters of a pound. Both of these fiber lengths, i.e. 0.1 mm and 0.03 mm, would be adequate for smooth metal surfaces without very high demands on surface finish. Accordingly, such switches could meet demands in a very wide variety of circumstances and would be readily adaptable to many specific requirements. Also for use as brushes against slip rings the examples should give very satisfactory service, albeit the brush loads should be substantially reduced in that case. As explained in the Appendix, brush wear should then be quite low.

With regard to most features, the brushes are novel and represent a valuable improvement for all reasonable values of $d/f^{\frac{2}{3}}$, say, at least to $d/f^{\frac{2}{3}}=5$ mm; e.g. in particular applications, such as in heavy current transmission, the method of using secondary and/or tertiary fibers can be most valuable for fiber brushes, up to, say, $d=1$ mm, and down to $f=0.1\%$ and almost regardless of their $d/f^{\frac{2}{3}}$ values. Also the method of using non-metallic matrix material, the method of using more than one working surface for any one brush, or of contacting more than one object by any one working surface, the method of using support fibers (which may be shorter than the fiber wires or may be of equal length or longer, whereby in the latter two cases the support fibers may run in tracks if the brush is used in relative motion, or which may meet depressions in the opposing surface when used at rest, in each case such as to give an appropriate elastic deformation to the fiber wires), all these are new and valuable for any choice of $d/f^{\frac{2}{3}}$ value. The same is true for the substitution of cylindrical support fibers by other shapes, e.g. foil-like, for their substitution by rollers rotating about an axis that is fixed with respect to the solid part of the brush and whose circumference is adjusted to meet the opposing surface being contacted when the fiber wires are bent to an appropriate degree. Also, novel and independent of the choice of $d/f^{\frac{2}{3}}$ is the method of conforming the working surfaces of the brush to the relative position and shape of the objects contacted by elastic and/or plastic deformation of the solid part of the brush, or by local melting of the matrix material, such shaping or conforming being done, optionally, before, during or after run-in, and which may go on in a continuing process during wear and use of the brush, as will be further explained below.

None of the examples adduced in the preceding specifications are meant to be exhaustive. By far too many modifications and variations of the present invention exist to name or describe them all. For example, instead of forming the brush stock by extrusion and cutting off pieces normal to the direction of extrusion, the cutting could be done at any angle, spheres could be made, holes could be drilled, and pieces of brush stock, not necessarily all of the same material, fiber characteristics, or relative fiber orientation, could be joined in planar arrays and/or in three-dimensional shapes, so that after etching electrical connection to objects of a great variety of different geometries with different surface characteristics, state of motion, shape and size could be effected singly or multiply in manifold relative orientations, all by one single or compositely assembled brush.

Further, given that the essential features of the brushes according to the invention depend on a large number of a-spots being made by very many fibers, it is not essential to specify the length of the fibers. For example, if the fibers should be embedded in a rubber matrix or in a matrix of similar great pliability, it may be not at all necessary to remove any of the soft elastic matrix since the fibers will slightly protrude from that matrix when pressure is applied due to their higher elastic modulus, as has been mentioned already. Such effect can also be created by stretching the matrix elastically normal to the fiber direction.

Similar action takes place also with metal matrices if fibers and matrix have significantly different elastic moduli, such as, for example, iridium fibers in an aluminum matrix. Therefore, electrical fiber brushes according to the invention include those in which the intended fiber wires are embedded in a matrix (metallic or non-metallic) of substantially lower elastic modulus, whether or not any of the matrix material has been removed from among the fibers prior to use, if the intent or effect is that by pressure, or by stress at an angle to the fiber direction, the needed fibrous part of the brush is generated (albeit only of very shallow depth in that case), or its thickness is enhanced via differential elastic strain.

As indicated previously, included in the invention is the possibility of generating the fibrous part of a brush by differential wear of the brush according to method 2, whether during use and/or initial run-in period, or to generate the fibrous part through superficial melting of matrix material during the manufacture and/or the operation of the brush and/or during an initial running-in period according to aforenoted method 3. Such differential melting can be effected by using a low-melting matrix material and using an appropriate current density to effect the matrix melting temperature at the desired distance from the working surface of the brush, for example. Indeed, all of the seven methods of making the fibrous parts are included as has already been indicated.

Similarly, the invention includes shaping of the working surface of the brush according to the aforenoted four methods, to permit many fibers to make mechanical contact with the object to which electrical connection shall be made, whether that shaping takes place during brush manufacture, during running-in, and/or during use of the brush. Thus, the invention also includes the possibility that the working surface of the brush is shaped in correspondence with the object to be contacted via plastic or elastic deformation of the brush body, the latter being especially feasible if the brush body has the geometry of a strip, sheet, chip or membrane, as in FIGS. 1*b*, *g*, *h* and *i*, or even forms part or all of a spring as in FIGS. 1*j* and *k*, again whether such plastic or elastic shaping is effected prior to, or during, brush use.

Again, as has already been discussed, the invention contemplates the possibility that the brush stock is manufactured in the form of sheets, strips, foils or membranes with the fibers directed at any desired angle to the normal of the plane of the sheets, strips, foils or membranes, whether metallic or non-metallic, as indicated for example in FIGS. 1*g*, 7*a* and 7*b*. It is suggested that matrix materials containing filaments of the desired diameter, packing density and length of the intended fiber wire material will be converted into sheets, strips, foils or membranes by heating the matrix to a point that it is liquid, or solid but much softer than the fiber wires, then by rolling or casting or by any other means shaping them into sheets, foils or membranes, and by the application of an electric or a magnetic field rotating fiber ends out of matrix material and thereby generating fibrous surface layers according to aforenoted methods 5 and 6. In this method fiber wires of basically non-magnetic material can be oriented by the action of an electric field; or else in prior steps of the manufacture ferromagnetism can be imparted to the fibers by giving them either a core of a ferro-magnetic material, e.g. nickel, cobalt or iron, or by coating them with a ferro-magnetic barrier material.

Further, it is envisaged that brushes whose matrix is non-metallic are given extra electrical conductivity for current access by plating them with a metal, wholly or partly. It is also contemplated to use brushes with the additional feature of immersing them wholly or partly in an electrically conductive liquid such as, for example, mercury or NaK or any other suitable metallic or non-metallic liquids, again as already discussed.

The invention further envisages the possibility that metal fiber electrical brushes according to the invention will be made in the form of membranes that are cooled from the back during use and/or are conformed to the object to be contacted by air or hydrostatic pressure of liquids acting on the membrane from behind, as discussed in conjunction with FIG. 1.

Very importantly, too, the invention also envisages that metal fiber brushes according to the invention will be made in the form of tows, or felted, or woven material in which at least part of the warp and/or weft, and/or threads, and/or ribbons are made of multifilamentary material from the surfaces of which the said fiber wires of diameter d are projecting at arbitrary angles and with arbitrary curvatures. Examples of this configuration are indicated in FIG. 7 and were discussed in conjunction with that figure.

APPENDIX: THEORETICAL BACKGROUND TO THE INVENTION

Electrical Brush Properties

From a theory presented by Adkins and Kuhlmann-Wilsdorf (Electrical Contacts-1979, IIT, Chicago, Ill., 1979, p. 171) supported by measurements made on various metal fiber electrical brushes, it can be derived that the electrical resistance of a metal fiber electrical brush whose working surface has area $A_B$ is given by $$R_B \simeq (\sigma_F/A_B K^2)[4E^2/(70\alpha f p_B^2)]^{\frac{1}{3}} \quad (1)$$

with $$K^2 = 1 + \sqrt[3]{4}\,(s/d)\,(\alpha f E/p_B)^{\frac{2}{3}} \quad (2)$$

provided that the a-spots are stressed elastically, where $\sigma_F$ is the film resistivity at the a-spots, E is the weighted average of Young's moduli of the fiber and contact materials at the working surface of the brush, d is the average fiber diameter at the working surface of the brush, $s \simeq 5\times10^{-10}$m is the undeformed gap width (i.e., the gap width before deformation by adhesive forces across the gap) through which effective electron tunneling takes place from fibers to substrate material and vice versa, $\alpha$ is the number of a-spots per fiber, $p_B = P/A_B$ (with P the brush load) is the brush pressure, and $fA_B$ is approximately equal to the total cross-sectional area of all of the fiber ends of diameter d at the working surface of the brush.

Figure 5:
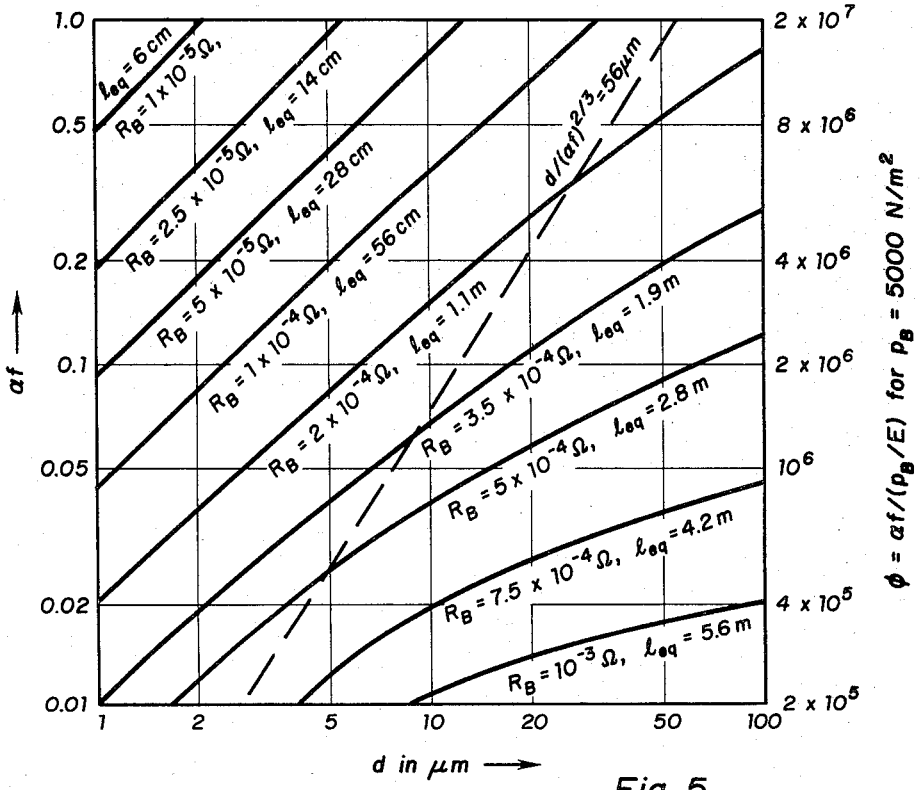
FIG. 5 is a diagram showing the theoretically predicted (see appendix) values of the resistance, $R_B$, of a working surface of area $A_B$, in full contact with an electrically conductive object, as well as the length, $l_{eq}$, of a copper cable of cross section $A_B$ whose resistance is equal to $R_B$ (for the case that $A_B = 1$ $cm^2$, that the film resistivity is $\sigma_F = 10^{-12}$ $\Omega m^2$, that the weighted average of Young's modulus pertaining to the a-spots is $E = 10^{11} N/m^2$, and that $p_B = 5000 N/m^2$) as a function of fiber diameter d and $\alpha f/(p_B/E)$, where $\alpha$ is the number of a-spots per fiber and f is the packing density of the fiber wires in the working surface of the brush. Also shown is the line $d/(\alpha f)^{\frac{2}{3}} = 56$ $\mu m$. Note that in the case of relative motion $\alpha \simeq 1$, and in the stationary case $\alpha \simeq 3$.

When $R_B$ is calculated from equations 1 and 2 and plotted in the manner of FIG. 5, it is seen that the predicted brush resistance decreases strongly with decreasing values of d, the fiber diameter, and increasing values of f, the packing density. For $K \simeq 1$, indeed for any constant value of $K^2$, equation (1) would not predict such a behavior but rather a mild dependence of $R_B$ on $\alpha f$ only (i.e. not on d), namely as $R_B \propto (\alpha f)^{-\frac{1}{3}}$. That type of behavior was known from earlier measurements on metal fiber brushes, and applies when $K^2$ is not much larger than unity. $K^2$ is the ratio of the total current-conducting, to the total load-bearing areas at the working surface of the brush, the extra current-conducting area being the annular zone about the load-bearing part of the $\alpha$-spot through which tunneling can take place. Measurements had indicated that for the most successful brushes to data $K^2 \simeq 2.5$. However, it had not been recognized that drastically different brush properties must be expected for $K^2$ large compared to unity (for practical purposes meaning, say $K^2 \gtrsim 5$) inasmuch as in that case $R_B A_B$ becomes virtually independent of $p_B$ and strongly dependent on f and d. Namely, for $K^2 \gtrsim 5$, and realizing that for the important case of relative motion $\alpha$ equals $\sim 1$, it is with $s = 5\times10^{-10}$ m $$R_B A_B \simeq \sigma_F d/(\sqrt[3]{70}\, fs) \simeq 5\times10^8 (m^{-1})\sigma_F d/f. \quad (3)$$

The requirement $K > 5$ depends on $p_B$ as seen from equation 2. A likely choice is $p_B/E \simeq 2\times10^{-8}$. Therefore, by the use of equation 2, one finds that equation 3 is applicable and brushes are dominated by the quantum mechanical effect of tunneling, if $$d/f^{\frac{2}{3}} \lesssim 56\ \mu m. \quad (4)$$

The line indicating equation 4 has been entered in FIG. 5. The region of quantum mechanical behavior is to the left of that line and is characterized by contours of constant $R_B$ which in this log/log plot are (almost) straight and oriented under 45°. The realm of preponderantly classical behavior lies to the right of the line of $d/f^{\frac{2}{3}} < 56\ \mu m$. It is characterized by curved contours of $R_B$. Also indicated in FIG. 5 are values of $l_{eq}$, the "equivalent length", defined as the length of a solid copper cable or rod, of same cross section as the brush, which would have the electrical resistance of $R_B$.

Available evidence indicates that the peak current density which may be passed through a metal fiber electrical brush without damaging it is that which causes a critical level of power loss per ampere. The total power loss, expressible, in units of volts, i.e. watt per ampere, consists of electrical loss, and mechanical loss. For a current I through the brush, the electrical loss per ampere is simply the electrical voltage drop across the brush/substrate interface, i.e.

$$V_E = R_B I = R_B A_B J \quad (5)$$

where $J = I/A_B$ is the current density through the macroscopic geometrical area of the working surface of the brush. The mechanical loss being $L_M = \mu p_B A_B v$, with $\mu$ the coefficient of friction and v the relative velocity, the total loss per ampere conducted is $$V_{eff} = (L_E + L_M)/I = R_B A_B J + \mu p_B v/J \quad (6)$$

Thus, for high current densities the mechanical loss, being inversely proportional to J, can typically be neglected compared to the electrical loss which rises linearly with J. Therefore, if the brush fails when $V_{eff}$ reaches the critical value of $V_{crit}$, then the maximum current density through the brush is, with equation 3, i.e. in the quantum mechanical range, $$J_{max} \approx [2\times 10^{-9}(m)f/\sigma_F d]V_{crit}. \quad (7a)$$

For $\sigma_F = 10^{-12}\Omega m^2$, which is an appropriate value for good metal fiber brushes, it is, then, $$J_{max} \approx [2000(A/m)f/d]V_{crit}. \quad (7b)$$

A-Spot Size and Behavior, and Brush Wear

Figure 6:
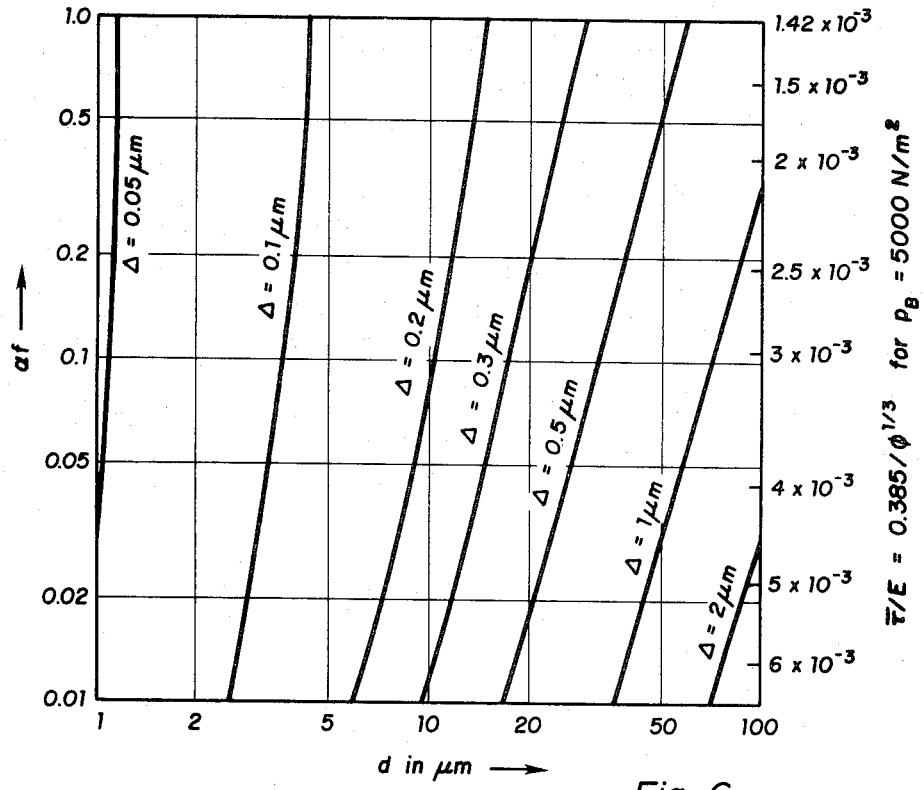
FIG. 6 is a diagram showing the calculated a-spot diameter, Δ, as a function of d, and $\alpha f$, and $\alpha f/(p_B/E)$, using the same parameters as in FIG. 5. Also shown is $\tau/E$, with $\tau$ the average stress at the a-spots. For the theory see the appendix.

Quantum-mechanical behavior of the brushes as described, for $d/f^{2/3} < 56\ \mu m$, requires that the a-spots are elastically stressed. The average stress on the a-spots is found from $$\bar{\tau} \approx p_B A_B / n\pi r_b^2 \quad (8)$$

where n is the number of a-spots in the working surface of the brush and $\pi r_b^2$ is the load-bearing contact area of the average a-spot. It can be shown that $$\bar{\tau}/E = 0.385(p_B/E\alpha f)^{1/2} \quad (9)$$

where, again, $\alpha = 1$ is the most reasonable assumption for relative motion (but $\alpha = 3$ at rest), while the diameter of the (presumed to be circular) a-spots is $$\Delta \approx 1.1\sqrt[3]{2\pi}\sqrt{sd} \approx \sqrt[2]{sd} \quad (10)$$

with $s \approx 5$ Å, provided $K >> 1$. FIG. 6 depicts Δ calculated according to the complete theory, using the same parameters for $\sigma_F$, $p_B$ and E as used in FIG. 5. In FIG. 6 the deviation of the curves Δ=const. from simply vertical lines indicates the error introduced by assuming $K^2 >> 1$ i.e. neglecting the 1 in equation 2.

For fiber diameters above a few hundred angstrom the values of Δ are judged to be large enough (namely $\Delta \gtrsim 100$ A) for ordinary ohmic behavior of the a-spots to be expected, and for size effects to be changing the theoretically derived results by less than a factor of two, at least at ambient and slightly elevated temperatures.

Also indicated in FIG. 6 is $\bar{\tau}/E$ which, as seen and in conformity with equation 9, is independent of d. The a-spots in ordinary monolithic brushes are stressed plastically which causes $\bar{\tau}/E$ to be in the range of $5\times 10^{-3}$ (compare R. Holm Electrical Contacts). Thus $\bar{\tau}/E$ for metal fiber brushes, even at $p_B \approx 2000$ N/m² and for very thin fibers, is not coarsely different from that for monolithic brushes.

The requirement of elastic a-spots means that $\bar{\tau}/E$ must not be larger than the elastic limit of the fiber material. Typically, this will mean $\bar{\tau}/E \lesssim 0.5\%$ except for very thin fibers for which $\bar{\tau}/E \lesssim 1\%$ is probably realistic. Namely, very thin fibers, i.e. with $d \lesssim 1\mu$, are known to have a higher yield stress than the corresponding bulk material. From equation 9, therefore, the theory applies as long as $$p_B/E \lesssim (f/0.385^3)\times 10^{-6} \approx 1.8\times 10^{-5} f \quad (11)$$

depending on choice of fiber material and fiber thickness.

Lastly, is is instructive to compute the elastic depression at the a-spots on account of the applied stress. This is found as $$h \approx r_b^2/d \approx 0.65 d(p_B/\alpha f E)^{2/3} \quad (12a)$$

Again, with $\alpha = 1$ as the most probable value, with $E = 10^{11}$ N/m² and $p_B = 5000$ N/m² as in FIGS. 5 and 6, this renders $$h \approx 8.8\times 10^{-6} d/f^{2/3} \quad (12b)$$

Thus, in the quantum mechanical range in which $d/f^{2/3} < 56\ \mu m$, it is $h \lesssim 5$ Å.

It is doubtful whether any such slight elastic deformation will cause dislocation motion beyond the elastic bowing of dislocation segments to radii below the critical radius for dislocation multiplication. For this reason it is expected that no mechanical wear at all takes place for quantum mechanical brushes at $p_B \lesssim 5000$ N/m².

Macroscopic Compliance of the Fibrous Part of the Brush

According to the preceding derivations brush properties are expected to improve with decreasing fiber diameters down to a few hundred angstrom diameter. For such thin fibers to support any brush pressure large enough to overcome aerodynamic lift at reasonable speeds and packing densities (which at $f \approx 0.1$, $d \approx 20\mu$, $l \approx 2$ mm and $v \gtrsim 5$ m/sec. requires $p_B \gtrsim 2000$ N/m² according to Adkins and Kuhlmann-Wilsdorf (Electrical Contacts-1979, IIT, Chicago, Ill., pp. 171–184)), the fibers should in some cases be less than 1 μm long. However, unavoidable irregularities in shaping the working surfaces and substrates are typically by far larger than 1 μm. Only in selected cases will it be feasible and desirable to hold tolerances to limits such that fibers with diameters down to a few hundred angstrom and lengths down to fractions of one micrometer can be used directly.

According to the invention, independent control of the macroscopic mechanical compliance of the fibrous part of the brush body, and of the fiber diameter at the working surface of the brush, is possible by step-wise changes of packing fraction and fiber diameter as a function of distance from the solid part of the brush. This will be readily appreciated by the consideration of a few simple facts: A deflection of δ will be caused at the end of a cantilever of length l, circular cross section of diameter d, and subject to a concentrated load F acting at its end at right angles to its axis, if $$F = \pi^3 E d^4 \delta / 64 l^3 = 0.15 E d^4 \delta / l^3 \quad (13)$$

provided that $\delta/l << 1$. If the same cantilever is subject to a force F acting at its end but in the direction of its axis, it will buckle when $$F_c = \pi^3 d^4 E / 256 l^2 \approx 0.12 E d^4 / l^2. \quad (14)$$

At load $F_c$, equation 13 certainly does not apply since δ/l would be near unity. However, the loading of the individual fibers in a fiber brush when used in relative motion is a mixture of the two cases and for proper mechanical action of the fiber brush in that case the individual fibers are bent through an arc of the order of $\alpha \simeq 20°$ within a factor of, say, 4 or so. Since a fiber of length l will form an arc of $\alpha$ if $\delta/l \simeq \alpha(1-\cos\alpha)$, the force to achieve bending about 20° would require $\delta/l \simeq 0.021$, and thus a force of $F \simeq 0.003Ed^4/l^2$ according to equation 13, or $F \simeq F_c/40$ with equation 14. Within a factor of, say, five to ten this value of F may be taken as an estimate of the range of the force per fiber needed for a metal fiber electrical brush to operate most satisfactorily mechanically when in relative motion. For a brush used in a switch or in a stationary application, F might well be much greater and even exceed $F_c$. It follows that an assembly of $N = A_B f/(\pi d^2/4)$ fibers in the fibrous part of a brush in relative motion would readily support a brush pressure of $$p_B^* \simeq F_c N/40A_B \simeq 0.003Ef(d/l)^2 \quad (15)$$

or brush pressures between 0.1 $p_B^*$ to 10 $p_B^*$ or so, depending on conditions (especially size and speed of the brush), when bent to favorable arcs to yield good resilience of the brush as a whole while keeping mechanical losses acceptably low. The gap between the rigid part of the brush and the contacted object would be shorter than the fiber length by an amount increasing with brush pressure; specifically at $p_B^*$ by about 2% (namely $[\alpha-(\sin\alpha)]/\alpha$ for $\alpha=20°$) than the fiber length.

While these numbers are meant to represent only a very rough guide to actual values of $p_B$, the salient feature is that the supportable brush pressure is proportional to $Ef(d/l)^2$. Thus if the fiber diameters in the fibrous part of a brush at rest are reduced with increasing distance from the solid part in accordance with the invention, then each layer of similar diameters, i.e. of the fibers at the working surface of the brush (with parameters E, f, d, and l), and of the secondary fibers (identified by subscript s) and tertiary fibers (identified by subscript t), if any, will be bent through similar arcs if $$Ef(d/l)^2 \simeq E_s f_s (d_s/l_s)^2 \simeq E_t f_t (d_t/l_t)^2 \quad (16)$$

where f, given by $$f = N\pi d^2/4A_B \quad (17a)$$

with N the number of fiber wires of diameter d at the working surface of the brush, is the ratio of the total cross-sectional area of the said fibers to $A_B$ the geometrical area of the working surface. Similarly, $f_s$ and $f_t$ are the ratios of the total cross sectional areas of the secondary and tertiary fibers to $A_B$. Thus $$f_s = f(d_s/d)^2/Ns \quad (17b)$$

and $$f_t = f_s(d_t/d_s)^2/N_t = f(d_t/d)^2/N_s N_t. \quad (17c)$$

Formally, the case of no tertiary fibers, i.e. secondary fibers projecting directly from the solid part of the brush, is described by $N_t=1$ and $d_t=d_s$ with $l_t=0$ so that in that case $f_t=f_s$. Similarly, if also no secondary fibers are present but the fiber wires project directly from the solid part of the brush, then $N_t=N_s=1$ and $d_t=d_s=d$ with $l_s=l_t=0$. However, it is not necessary that $d_t=d_s=d$ if $N_t=N_s=1$ since the fiber diameter can be stepped from $d_t$ to $d_s<d_t$ and thence to $d<d_s$, without increasing the number of fibers, indeed without change in material, and l, $l_s$ and $l_t$ can be chosen freely and independent of each other.

Since at least the secondary and tertiary fibers are usually composed of two or more different materials, at least one of them (namely the fiber wires of diameter d) being electrically conductive, most often a metal, the Young's moduli $E_s$ and $E_t$ are measuring the stiffness of these wires and are a weighted average value of the Young's moduli of the different materials making up the fibers.

Altogether, the geometrical interrelationships in the fibrous part of the brush may be presented in tabular form as follows.

TABLE A

| | Fiber Wires | Secondary Fibers | Tertiary Fibers |
|---|---|---|---|
| Diameter | d | $d_s$ | $d_t$ |
| Length | l | $l_s$ | $l_t$ |
| Aspect Ratio | l/d | $l_s/d_s$ | $l_t/d_t$ |
| Number in Group | $N_s \geqq 1$ | $N_t \geqq 1$ | — |
| Total Number in Brush | $N = 4fA_B/\pi d^2$ | $N/N_s = 4f_sA_B/\pi d_s^2$ | $N/N_sN_t = 4f_tA_B/\pi d_t^2$ |
| Packing fraction | f | $f_s = f(d_s/d)^2/N_s \geqq f$ | $f_t = f_s(d_t/d_s)^2N_t = f(d_t/d)^2/N_sN_t \geqq f_s \geqq f$ |
| Effective Young's Modulus | E | $E_s$ | $E_t$ |
| $E_jf_j(d_j/l_j)^2$ | $Ef(d/l)^2$ | $E_sf_s(d_s/l_s)^2 = E_sfd_s^4/(N_sl_s^2d^2)$ | $E_tf_t(d_t/l_t)^2 = E_tfd_t^4/(N_sN_tl_t^2d^2)$ |

What is claimed as new and desired to be secured by Letters Patent of the United States is:

1. An electrical brush for making electrical connection to at least one object, comprising:

a solid brush body formed of a matrix material having embedded therein at least one set of plural fibers;

at least one fibrous brush part, and in general M fibrous brush parts, extending from said brush body and at least partly formed of at least part of said at least one set of fibers, said fibrous brush part substantially free of matrix material and defining at least one working surface, and in general Q working surfaces, adapted for making electrical contact with at least one object, and in general Z objects, said at least one working surface formed of compositely shaped surfaces of at least some of the fibers forming said at least one fibrous part, including at least one set, and in general Y sets, of electrically conductive fiber wires adapted for making electrical connection to said at least one object at said working surface, said fiber wires having an average crossectional area A, an average exposed length l, an average diameter $d=\sqrt{4A/\pi}$, and a packing density f;

said at least one set of fiber wires extending from secondary fibers of diameter $d_s$ in groups of $N_s$ fiber wires per secondary fiber, and said secondary fibers extending from tertiary fibers of diameter $d_t$ in groups of $N_t$ secondary fibers per tertiary fiber, and these tertiary fibers extending from, and being partially embedded in, said brush body;

wherein at least a selected one of M, Q, Y, $N_s$, $N_t$, $d_s/d$ and $d_t/d_s>1$, the remaining non-selected of M, Q, Y, $N_s$, $N_t$, $d_s/d$ and $d_t/d_s$ respectively being $\geqq 1$.

2. An electrical brush according to claim 1, wherein the secondary fibers extend directly from the brush body, meaning that $N_t=d_t/d_s=1$.

3. An electrical brush for making electrical connection to at least one object, comprising:

a solid brush body formed of a matrix material having embedded therein at least one set of plural fibers;

at least one fibrous brush part, and in general $M\geqq 1$ fibrous brush parts, extending from said brush body and at least partly formed of at least part of said at least one set of fibers, said fibrous brush part substantially free of matrix material and defining at least one working surface, and in general $Q\geqq 1$ working surfaces, adapted for making electrical contact with at least one object, and in general $Z\geqq 1$ objects, said at least one working surface formed of the compositely shaped surfaces of at least some of the fibers forming said at least one fibrous part, including at least one set, in general $Y\geqq 1$ sets, of electrically conductive fiber wires for making electrical connection to said at least one object at said working surface, said fiber wires having an average crossectional area A, an average exposed length l, an average diameter $d=\sqrt{4A/\pi}$, and a packing density f;

said at least one set of fiber wires extending from secondary fibers of diameter $d_s$ in groups of $N_s\geqq 1$ fiber wires per secondary fiber, and said secondary fibers extending from tertiary fibers of diameter $d_t$ in groups of $N_t\geqq 1$ secondary fibers per tertiary fiber, and these tertiary fibers extending from, and being partially embedded in, said brush body;

wherein M, Q, Y, $N_s$, $N_t$, $d_s$, $d_t$, d and l may be chosen at will; and wherein the majority of the fiber wires in said at least one fibrous part have orientation angles between 10° and 170° with respect to the fibers embedded in said matrix material near the center of said brush body in the region closest to said fiber wires in said fibrous part, said orientation angles determined while no working surface of said at least one fibrous part makes mechanical contact with any solid object.

4. An electrical brush according to claim 1, 2 or 3 wherein: $d/f^{\frac{2}{3}}<0.5$ mm.

5. An electrical brush according to claim 1, 2 or 3 wherein: $d/f^{\frac{2}{3}}<56$ μm.

6. An electrical brush according to claim 4, wherein: $Y>1$.

7. An electrical brush according to claim 4, wherein: $M>1$.

8. An electrical brush according to claim 4, wherein: $Q>1$.

9. An electrical brush according to claim 4, wherein: $N_s>1$.

10. An electrical brush according to claim 4, wherein: $N_t>1$.

11. An electrical brush according to claim 4, wherein: at least one of the parameters Y, M, Q, $N_s$ and $N_t$ is larger than 1.

12. An electrical brush according to claim 4, wherein: at least two of the parameters Y, M, Q, $N_s$ and $N_t$ are larger than 1.

13. An electrical brush according to claim 1, 2 or 3, wherein:

the fiber wires of diameter d and packing density f exhibit a film resistivity of $\sigma_F<3\times 10^{-11}\Omega m^2$ when tested against a polished copper rotor in a pure argon atmosphere.

14. An electrical brush according to claims 1, 2 or 3, wherein:

the fiber wires of diameter d and packing density f exhibit a film resistivity of $\sigma_F<8.10^{-12}\Omega m^2$ when tested against a polished copper rotor in a pure argon atmosphere.

15. An electrical brush according to claims 1, 2 or 3, further comprising:

said fiber wires consisting of a material selected from the group consisting of a noble metal, Al, Ti, Zr, Ta, Mo, W, Nb, Fe, Co, Ni, Cu, Zn, Cd, Tl and high concentration alloys thereof.

16. An electrical brush according to claims 1, 2 or 3, further comprising:

the matrix material of said brush body comprising at least one metal.

17. An electrical brush according to claims 1, 2 or 3, further comprising:

the matrix material of said brush body comprising at least one ceramic.

18. An electrical brush according to claim 17, wherein said matrix material comprises glass.

19. An electrical brush according to claims 1, 2 or 3, further comprising:

the matrix material of said brush body comprising at least one elastomer.

20. An electrical brush according to claims 1, 2 or 3, further comprising:

the matrix material of said brush body made of at least one metal together with at least one non-metal.

21. An electrical brush according to claims 1, 2 or 3, further comprising:

said brush body at least partially plated with a metal.

22. An electrical brush according to claims 1, 2 or 3, further comprising:

said brush body made at least partly by the "in-situ" formation of fibers wherein a starting material comprising a mechanical mixture of at least two materials of which at least one is present in the form of separate dispersed particles is deformed in a manner to elongate the particles into shapes in which one dimension is at least an order of magnitude greater than any others at right angles thereto.

23. An electrical brush according to claims 1, 2 or 3, further comprising:

said secondary fibers made at least partly by the "in-situ" formation of fibers wherein a starting material comprising a mechanical mixture of at least two materials of which at least one is present in the form of separate dispersed particles is deformed in a manner to elongate the particles into shapes in which one dimension is at least an order of magnitude greater than any other at right angles thereto.

24. An electrical brush according to claims 1, 2 or 3, further comprising:

at least a selected one of a selected set of said fiber wires, secondary fibers and tertiary fibers comprising a ferromagnetic material.

25. An electrical brush according to claim 22, further comprising:

at least a selected one of a selected set of said fiber wires, secondary fibers and tertiary fibers comprising a ferromagnetic material.

26. An electrical brush according to claim 23, further comprising:

at least a selected one of a selected set of said fiber wires, secondary fibers and tertiary fibers comprising a ferromagnetic material.

27. An electrical brush according to claims 1, 2 or 3, further comprising:

at least one fibrous part made at least partially by the application of an electric field to at least some of the material out of which the brush is made, said application of electric field done while the matrix material is softened by application of heat to produce the extension of parts of at least some of said fibers from said matrix material.

28. An electrical brush according to claim 22, further comprising:

at least one fibrous part made at least partially by the application of an electric field to at least some of the material out of which the brush is made, said application of electric field done while the matrix material is softened by application of heat to produce the extension of parts of at least some of said fibers from said matrix material.

29. An electrical brush according to claim 23, further comprising:

at least one fibrous part made at least partially by the application of an electric field to at least some of the material out of which the brush is made, said application of electric field done while the matrix material is softened by application of heat to produce the extension of parts of at least some of said fibers from said matrix material.

30. An electrical brush according to claims 1, 2 or 3, further comprising:

at least one fibrous part made at least partially by the application of a magnetic field to at least some of the material out of which the brush is made, said application of magnetic field done while the matrix material is softened by application of heat to produce the extension of parts of at least some of said fibers from said matrix material.

31. An electrical brush according to claim 22, further comprising:

at least one fibrous part made at least partially by the application of a magnetic field to at least some of the material out of which the brush is made, said application of magnetic field done while the matrix material is softened by application of heat to produce the extension of parts of at least some of said fibers from said matrix material.

32. An electrical brush according to claim 23, further comprising:

at least one fibrous part made at least partially by the application of a magnetic field to at least some of the material out of which the brush is made, said application of magnetic field done while the matrix material is softened by application of heat to produce the extension of parts of at least some of said fibers from said matrix material.

33. An electrical brush according to claims 1, 2 or 3, further comprising said brush body in the form of a chip.

34. An electrical brush according to claim 22, further comprising said brush body in the form of a chip.

35. An electrical brush according to claim 23, further comprising said brush body in the form of a chip.

36. An electrical brush according to claims 1, 2 or 3, further comprising:

said brush body shaped such that one dimension is much smaller than any dimension at right angles thereto, such as in a membrane, strip, sheet or ribbon.

37. An electrical brush according to claim 32, further comprising:

said brush body shaped such that one dimension is much smaller than any dimension at right angles thereto, such as in a membrane, strip, sheet or ribbon.

38. An electrical brush according to claim 23, further comprising:

said brush body shaped such that one dimension is much smaller than any dimension at right angles thereto, such as in a membrane, strip, sheet or ribbon.

39. An electrical brush according to claims 1, 2 or 3, further comprising:

said brush body shaped such that one dimension is much larger than any dimension at right angles thereto, such as a wire, filament thread or tow of filaments.

40. An electrical brush according to claim 22, further comprising:

said brush body shaped such that one dimension is much larger than any dimension at right angles thereto, such as a wire, filament thread or tow of filaments.

41. An electrical brush according to claim 23, further comprising:

said brush body shaped such that one dimension is much larger than any dimension at right angles thereto, such as a wire, filament thread or tow of filaments.

42. An electrical brush according to claims 1, 2 or 3, further comprising:

said brush body formed of elements in which one dimension is much longer than any dimension at right angles thereto, such as a felt made out of filaments or wires.

43. An electrical brush according to claim 22, further comprising:

said brush body formed of elements in which one dimension is much longer than any dimension at right angles thereto, such as a felt made out of filaments or wires.

44. An electrical brush according to claim 23, further comprising:

said brush body formed of elements in which one dimension is much longer than any dimension at right angles thereto, such as a felt made out of filaments or wires.

45. An electrical brush according to claims 1, 2 or 3, further comprising:

a flexible brush body made of at least one element in which one dimenson is much longer than any dimension at right angles thereto, said at least one element intertwined in a regular fashion such as in cloth, carpeting, hosiery, nets, baskets or other.

46. An electrical brush according to claim 22, further comprising:

a flexible brush body made of at least one element in which one dimension is much longer than any dimension at right angles thereto, said at least one element intertwined in a regular fashion such as in cloth, carpeting, hosiery, nets, baskets or other.

47. An electrical brush according to claim 23, further comprising:

a flexible brush body made of at least one element in which one dimension is much longer than any dimension at right angles thereto, said at least one element intertwined in a regular fashion such as in cloth, carpeting, hosiery, nets, baskets or other.

48. An electrical brush according to claims 1, 2 or 3, further comprising:

said brush body made in the shape of a spring, and exhibiting a spring characteristic $F=kx$, where k is a spring constant and F is a force produced by a change of distance x of said brush body as it is confined between a current carrying object and said at least one object to which electrical connection is to be made.

49. An electrical brush according to claims 1, 2 or 3, further comprising:

said brush body forming at least part of a hollow container adapted to be filled with a fluid under pressure such as for the purpose of cooling.

50. An electrical brush according to claim 23, further comprising:

said brush body forming at least part of a hollow container adapted to be filled with a fluid under pressure such as for the purpose of cooling.

51. An electrical brush according to claim 23, further comprising:

said brush body forming at least part of a hollow container adapted to be filled with a fluid under pressure such as for the purpose of cooling.

52. An electrical brush according to claims 1, 2 or 3, further comprising:

a flexible brush body adapted to be acted on by a fluid under pressure such as to conform the shape of said at least one working surface of the brush to said at least one object.

53. An electrical brush according to claim 22, further comprising:

a flexible brush body adapted to be acted on by a fluid under pressure such as to conform the shape of said at least one working surface of the brush to said at least one object.

54. An electrical brush according to claim 23, further comprising:

a flexible brush body adapted to be acted on by a fluid under pressure such as to conform the shape of said at least one working surface of the brush to said at least one object.

55. An electrical brush according to claims, 1, 2 or 3, further comprising:

said brush body exhibiting sufficient elastic deformability to permit conforming at least one working surface of the brush to said at least one object.

56. An electrical brush according to claim 22, further comprising:

said brush body exhibiting sufficient elastic deformability to permit conforming at least one working surface of the brush to said at least one object.

57. An electrical brush according to claim 23, further comprising:

said brush body exhibiting sufficient elastic deformability to permit conforming at least one working surface of the brush to said at least one object.

58. An electrical brush according to claims 1, 2 or 3, further comprising:

said brush body exhibiting sufficient plastic deformability to permit conforming at least one working surface of the brush to said at least one object.

59. An electrical brush according to claim 22, further comprising:

said brush body exhibiting sufficient plastic deformability to permit conforming at least one working surface of the brush to said at least one object.

60. An electrical brush according to claim 23, further comprising:

said brush body exhibiting sufficient plastic deformability to permit conforming at least one working surface of the brush to said at least one subject.

61. An electrical brush according to claims 1, 2 or 3, further comprising:

said brush body made of a matrix material sufficiently less rigid than the material of at least one set of fibers embedded therein such that without prior removal of matrix material at least one set of fibers can be made to protrude beyond the local surrounding surface of the solid part of the brush by forces, pressures and/or stresses applied to a part of the brush.

62. An electrical brush according to claims 1, 2 or 3, further comprising:

at least one set of support fibers, substantially more rigid than said at least one set of fiber wires and of an orientation, distribution, shape and/or length adjusted to the local intended distance between the body of the brush and the surface of the object to which electrical connection is to be made, such that when the support fibers touch the said object, the fiber wires of diameter d are bent in a predetermined manner.

63. An electrical brush according to claim 62, further comprising:

said support fibers comprising at least one metal.

64. An electrical brush according to claim 62, further comprising:

said support fibers comprising at least one non-metal.

65. An electrical brush according to claim 62, further comprising:

said support fibers comprising at least one metal and at least one non-metal.

66. An electrical brush according to claim 62, further comprising:

said support fibers having a cross-sectional shape which, in a plane normal to the fibers in the fibrous part of the brush is roughly equiaxed or circular.

67. An electrical brush according to claim 62, further comprising:

said support fibers having a cross-sectional shape which, in the plane normal to the fibers in the fibrous part of the brush, is elongated in at least one direction.

68. An electrical brush according to claim 62, further comprising:

said support fibers having projecting therefrom plural metal fiber wires of a cross-sectional area substantially smaller than the cross-sectional area of the support fibers, and of a length such that said metal fiber wires touch the object to which electrical connection is made when the brush is in a predetermined working mode.

69. An electrical brush according to claim 62, further comprising:

said support fibers having projecting therefrom plural metal fiber wires of a cross-sectional area substantially smaller than the cross-sectional area of the support fibers, and of a length such that said fiber wires touch the object to which electrical connection is made when the brush is mechanically overloaded beyond a predetermined load.

70. An electrical brush for making electrical connection to at least one object, comprising:

a solid brush body formed of a matrix material having embedded therein at least one set of plural fibers;

at least one fibrous brush part extending from said brush body and at least partly formed of at least part of said at least one set of fibers, said fibrous brush part substantially free of said matrix material and defining at least one working surface adapted for making contact with at least one object;

said fibers including at least one set of electrically conductive fiber wires adapted for making electrical connection to said at least one object at said working surface, said fiber wires having an average cross-sectional area A, an average exposed length l, an average diameter d, where $d=\sqrt{4A/\pi}$, and a packing density f;

said fibrous part at least including secondary fibers of average diameter $d_s$ ($d_2>d$) embedded in and extending from said matrix material, said fiber wires embedded in and extending from said secondary fibers wherein:

$$d<1 \text{ mm}$$

$$l/d<1000$$

71. An electrical brush for making electrical connection to at least one object, comprising:

a solid brush body comprising at least one flexible part formed of a matrix material having embedded therein at least one set of plural fibers;

at least one fibrous brush part extending from said flexible part of said brush body and at least partly formed of at least part of said at least one set of fibers, said fibrous brush part substantially free of matrix material and defining at least one working surface adapted for making contact with at least one object;

said fibers including at least one set of electrically conductive fiber wires adapted for making electrical connection to said at least one object at said working surface, said fiber wires having an average cross-sectional area A, an average exposed length l, an average diameter d, where $d=\sqrt{4A/\pi}$, and a packing density f;

said fibrous part at least including secondary fibers of average diameter $d_s$ ($d_s>d$) embedded in and extending from said matrix material, said fiber wires embedded in and extending from said secondary fibers;

wherein $$d/f^{\frac{1}{3}}<5 \text{ mm, and}$$

$$d<0.5 \text{ mm.}$$

72. An electrical brush according to claim 70, further comprising:

said fibrous part including tertiary fibers of average diameter $d_t$ ($d_t>d_s$) embedded in and extending from said matrix material, said secondary fibers embedded in and extending from said tertiary fibers.

73. An electrical brush according to claim 71, further comprising:

the fiber wires of said at least one fibrous part having an average cross-sectional area A, an average exposed length l, an average diameter d, where $d=\sqrt{4/\pi}$, and a packing density f;

at least one fibrous part including secondary fibers of average diameter $d_s$ ($d_s<d$) embedded in and extending from said matrix material, said fiber wires embedded in, and extending from, said secondary fibers.

74. An electrical brush according to claims 70, 71, 72 or 73, further comprising:

$$d/f^{\frac{1}{3}}<56 \ \mu\text{m.}$$

75. An electrical brush according to claims 70, 71, 72 or 73, further comprising:

spacing means more rigid than said exposed fiber wires coupled to said solid brush body for limiting the amount of bending of the exposed fiber wires.

76. An electrical brush according to claim 75, wherein said spacing means comprises:

plural support fibers embedded in said matrix material and extending therefrom.

77. An electrical brush according to claim 75, wherein said spacing means comprises:

at least one roller coupled to said solid brush body.

78. An electrical brush according to claim 74, wherein:

the fiber wires of diameter d and packing density f exhibit a film resistivity of $\sigma_F<3\times10^{-11}\Omega m^2$ when tested against a polished copper rotor in a pure argon atmosphere.

79. An electrical brush according to claim 74, wherein:

the fiber wires of diameter d and packing density f exhibit a film resistivity of $\sigma_F<8\times10^{-12}\Omega m^2$ when tested against a polished copper rotor in a pure argon atmosphere.

80. An electrical brush according to claim 74, further comprising:

the matrix material of said brush body comprising at least one metal.

81. An electrical brush according to claim 74, further comprising:

the matrix material of said brush body comprising at least one ceramic.

82. An electrical brush according to claim 81, wherein the brush body matrix material comprises glass.

83. An electrical brush according to claim 74, further comprising:

the matrix material of said brush body comprising at least one elastomer.

84. An electrical brush according to claim 74, further comprising:

the matrix material of said brush body comprising at least one metal together with at least one non-metal.

85. An electrical brush according to claim 74, further comprising:

said brush body at least partially plated with a metal.

86. An electrical brush according to claim 74, further comprising:

said brush body made at least partly by the "in-situ" formation of fibers wherein a starting material comprising a mechanical mixture of at least two materials of which at least one is present in the form of separate dispersed particles is deformed in a manner to elongate the particles into shapes in which one dimension is very much longer than all others at right angles thereto.

87. An electrical brush according to claim 74, further comprising:

at least a selected one of a selected set of said fiber wires, secondary fibers and tertiary fibers comprising a ferromagnetic material.

88. An electrical brush according to claim 74, further comprising:

at least one fibrous part made at least partially by the application of an electric field to at least some of the material out of which the brush is made, said application of electric field done while the matrix material is softened by application of heat to produce the extension of parts of at least some of said fibers from said matrix material.

89. An electrical brush according to claim 74, further comprising:

at least one fibrous part made at least partially by the application of a magnetic field to at least some of the material out of which the brush is made, said application of magnetic field done while the matrix material is softened by application of heat to produce the extension of parts of at least some of said fibers from said matrix material.

90. An electrical brush according to claim 74, further comprising said brush body in the form of a chip.

91. An electrical brush according to claim 74, in which one dimension thereof is much larger than any dimension at right angles thereto.

92. An electrical brush according to claim 74, further comprising:

a flexible brush body made of at least one element in which one dimension is much longer than any dimension at right angles thereto, said elements intertwined in a regular fashion such as in cloth, carpeting, hosiery, nets, and baskets.

93. An electrical brush according to claim 74, further comprising:

said brush body made in the shape of a spring, and exhibiting a spring characteristic $F=kx$, where k is a spring constant and F is a force produced by a change of distance x of said brush body as it is confined between a current carrying object and said at least one object to which electrical connection is to be made.

94. An electrical brush according to claim 74, further comprising:

said brush body forming at least part of a hollow container adapted to be filled with a fluid under pressure such as for the purpose of cooling.

95. An electrical brush according to claim 74, further comprising:

said brush body adapted to be acted on by a fluid under pressure such as to conform the shape of said at least one working surface of the brush to said at least one object.

96. An electrical brush according to claim 74, further comprising:

said brush body exhibiting sufficient elastic deformability to permit conforming at least one working surface of the brush to at least one object.

97. An electrical brush according to claim 74, further comprising:

said brush body exhibiting sufficient plastic deformability to permit conforming at least one working surface of the brush to at least one object.

98. An electrical brush according to claim 74, further comprising:

said brush body made of a matrix material sufficiently less rigid than the material of at least one set of fibers embedded therein such that without prior removal of matrix material at least one set of fibers can be made to protrude beyond the local surround surface of the solid part of the brush by application of forces, pressures and/or stresses to a part of the brush.

99. An electrical brush according to claims 70, 71, 72 or 73 further comprisng:

the majority of the fiber wires of said at least one fibrous part having orientation angles between 10° and 170° with respect to the fibers embedded in said matrix material near the center of said brush body in the region closest to said fiber wires in said fibrous part, said orientation angles determined while no working surface of said at least one fibrous part makes mechanical contact with any solid object.

100. An electrical brush according to claim 74, further comprising:

the majority of the fiber wires of said at least one fibrous part having orientation angles between 10° and 170° with respect to the fibers embedded in said matrix material near the center of said brush body in the region closest to said fiber wires in said fibrous part, said orientation angles determined while on working surface of said at least one fibrous part makes mechanical contact with any solid object.

* * * * *